US010380986B2

(12) United States Patent
Baker

(10) Patent No.: US 10,380,986 B2
(45) Date of Patent: Aug. 13, 2019

(54) MEANS AND METHODS FOR SWITCHING ODD AND EVEN NUMBERS OF MATCHED PICKUPS TO PRODUCE ALL HUMBUCKING TONES

(71) Applicant: Donald L Baker, Tulsa, OK (US)

(72) Inventor: Donald L Baker, Tulsa, OK (US)

( * ) Notice: Subject to any disclaimer, the term of this patent is extended or adjusted under 35 U.S.C. 154(b) by 0 days.

(21) Appl. No.: 16/139,027

(22) Filed: Sep. 22, 2018

(65) Prior Publication Data

US 2019/0057678 A1 Feb. 21, 2019

Related U.S. Application Data

(63) Continuation-in-part of application No. 15/917,389, filed on Jul. 14, 2018, and a continuation-in-part of (Continued)

(51) Int. Cl.
*G10H 3/18* (2006.01)
*G10H 1/46* (2006.01)
(Continued)

(52) U.S. Cl.
CPC ..... *G10H 3/181* (2013.01); *G10H 1/18* (2013.01); *G10H 1/342* (2013.01); *G10H 1/46* (2013.01);
(Continued)

(58) Field of Classification Search
CPC . H03H 2001/0057; H01F 27/38; H01F 29/04; H01F 7/0273; H01F 38/14; H01F 1/0063; H01F 27/2823; H01F 37/00; H01F 17/06; H01F 2017/065; H01F 2017/067; H01F 27/2804; H01F 27/42; H01F 7/06;
(Continued)

(56) References Cited

U.S. PATENT DOCUMENTS 1,915,858 A 7/1933 Miessner
2,026,841 A 1/1936 Lesti
(Continued)

OTHER PUBLICATIONS

French, Richard Mark, Engineering the Guitar, Theory and Practice, 2009, Springer, New York, USA.

*Primary Examiner* — Marlon T Fletcher

(57) ABSTRACT

This invention discloses a switching system for any odd or even number of two or more matched vibrations sensors, such that all possible circuits of such sensors that can be produced by the system are humbucking, rejecting external interferences signals. The sensors must be matched, especially with respect to response to external hum and internal impedance, and be capable of being made or arranged so that the responses of individual sensors to vibration can be inverted, compared to another matched sensor, placed in the same physical position, while the interference signal is not. Such that for 2, 3, 4, 5, 6, 7 and 8 sensors, there exist 1, 6, 25, 90, 301, 966 and 3025 unique humbucking circuits, respectively, with signal outputs that can be either single-ended or differential. Embodiments of switching systems include electro-mechanical switches, programmable switches, solid-state digital-analog switches, and micro-controller driven solid state switches using time-series to spectral-series transforms to pick the order of tones from bright to warm and back.

11 Claims, 10 Drawing Sheets

Related U.S. Application Data application No. 15/616,396, filed on Jun. 7, 2017, now Pat. No. 10,217,450, and a continuation-in-part of application No. 14/338,373, filed on Jul. 23, 2014, now Pat. No. 9,401,134.

(60) Provisional application No. 62/711,519, filed on Jul. 28, 2018, provisional application No. 62/569,563, filed on Oct. 8, 2017.

(51) Int. Cl.
*G10H 1/18* (2006.01)
*G10H 3/22* (2006.01)
*G10H 1/34* (2006.01)

(52) U.S. Cl.
CPC ..... *G10H 3/185* (2013.01); *G10H 3/188* (2013.01); *G10H 3/22* (2013.01); *G10H 2220/505* (2013.01)

(58) Field of Classification Search
CPC ..... H01F 7/066; H01F 10/007; H01F 13/006; H01F 1/445; H01F 2003/005; H01F 21/08; H01F 6/06; H01H 50/002; H01H 9/56; H01H 47/002; H01H 47/22; H01H 50/323; H01H 2009/307; H01H 47/02; H01H 47/26; H01H 50/16; H01H 50/38; H01H 71/082; H01H 89/00; H01H 9/26; H01H 9/563; H01H 31/003; H01H 2239/076; H01H 2300/03; H01H 50/86; H01H 50/546; H01H 13/72; H01H 47/325; H01H 50/048; H01H 50/22; H01H 51/065; H01H 9/48; H01H 13/023; H01H 13/70; H01H 1/0094; H01H 2050/049; H01H 2201/02; H01H 2215/05; H01H 2219/06; H01H 2219/062; H01H 2239/012; H01H 2300/032; H01H 33/08; H01H 3/503; H01H 50/026; H01H 50/14; H01H 50/163; H01H 50/44; H01H 50/443; G10H 3/182; G10H 3/181; G10H 2220/505; G10H 3/22; G10H 2220/515; G10H 3/183; G10H 1/18; G10H 3/14
See application file for complete search history.

(56) References Cited

U.S. PATENT DOCUMENTS

| | | | | |
|---|---|---|---|---|
| 2,455,575 | A | 12/1948 | Fender | |
| 2,557,754 | A | 6/1951 | Morrison | |
| 2,896,491 | A | 7/1959 | Lover | |
| 2,968,204 | A | 1/1961 | Fender | |
| 2,976,755 | A | 3/1961 | Fender | |
| 3,290,424 | A | 12/1966 | Fender | |
| 3,916,751 | A | 11/1975 | Stich | |
| 4,305,320 | A | 12/1981 | Peavey | |
| 4,379,421 | A | 4/1983 | Nunan | |
| 4,501,185 | A | 2/1985 | Blucher | |
| 4,545,278 | A | 10/1985 | Gagon | |
| 4,581,975 | A * | 4/1986 | Fender | G10H 3/182 84/720 |
| 5,136,918 | A | 8/1992 | Riboloff | |
| 5,292,998 | A | 3/1994 | Knapp | |
| 5,311,806 | A | 5/1994 | Riboloff | |
| 5,523,526 | A * | 6/1996 | Shattil | G01R 33/42 84/728 |
| 5,763,808 | A | 6/1998 | Thomson | |
| 5,898,121 | A * | 4/1999 | Riboloff | G10H 3/186 84/725 |
| 6,034,316 | A * | 3/2000 | Hoover | G10H 3/186 84/738 |
| 6,781,050 | B2 | 8/2004 | Olvera | |
| 6,998,529 | B2 | 2/2006 | Wnorowski | |
| 7,276,657 | B2 | 10/2007 | Bro | |
| 9,196,235 | B2 | 11/2015 | Ball et al. | |
| 9,401,134 | B2 | 7/2016 | Baker | |
| 9,640,162 | B2 | 5/2017 | Ball et al. | |
| 2005/0150364 | A1* | 7/2005 | Krozack | G10H 3/182 84/726 |
| 2009/0308233 | A1 | 12/2009 | Jacob | |
| 2011/0290099 | A1* | 12/2011 | Franklin | G10H 3/182 84/733 |
| 2012/0024129 | A1 | 2/2012 | Ball et al. | |
| 2014/0245877 | A1* | 9/2014 | Gelvin | G10H 3/181 84/727 |
| 2016/0027422 | A1* | 1/2016 | Baker | G10H 3/22 84/726 |
| 2019/0057678 | A1* | 2/2019 | Baker | G10H 3/181 |

* cited by examiner

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

MEANS AND METHODS FOR SWITCHING ODD AND EVEN NUMBERS OF MATCHED PICKUPS TO PRODUCE ALL HUMBUCKING TONES

This application claims the precedence in elements of U.S. Provisional Patent Application No. 62/711,519, filed 2018 Jul. 28, U.S. Non-Provisional patent application Ser. No. 15/917,389, filed 2018 Jul. 14, U.S. Provisional Patent Application No. 62/569,563, filed 2017 Oct. 8, U.S. Non-Provisional patent application Ser. No. 15/616,396, filed 2017 Jun. 7, and U.S. Pat. No. 9,401,134B2, filed 2014 Jul. 23, granted 2016 Jul. 26, by this inventor, Donald L. Baker dba android originals LC, Tulsa Okla. USA

CROSS-REFERENCE TO RELATED APPLICATIONS

This application is related to the use of matched single-coil electromagnetic pickups, as related in U.S. Pat. No. 9,401,134B2, filed 2014 Jul. 23, granted 2016 Jul. 26, in U.S. NP patent application Ser. No. 15/616,396, filed 2017 Jun. 7, in U.S. Provisional Patent Application No. 62/522,487, filed 2017 Jun. 20, in U.S. Provisional Patent Application No. 62/569,563, filed 2017 Oct. 8, in U.S. Provisional Patent Application No. 62/711,519, filed 2018 Jul. 28, and in U.S. NP patent application Ser. No. 15/917,389, 2018 (exact filing date subject to granting of petition) by this inventor, Donald L. Baker dba android originals LC, Tulsa Okla. USA.

COPYRIGHT AUTHORIZATION

Other than for confidential and/or necessary use inside the Patent and Trademark Office, this authorization is denied until the Non-provisional Patent Application is published (pending any request for delay of publication), at which time it may be taken to state:

The entirety of this application, specification, claims, abstract, drawings, tables, formulae etc., is protected by copyright: © 2018 Donald L. Baker dba android originals LLC. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

APPLICATION PUBLICATION DELAY

This requests that this NPPA not be published prior to the granting of the patent.

DESCRIPTION

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENTS REGARDING PRIOR DISCLOSURES BY THE INVENTOR OR A JOINT INVENTOR

Not Applicable

TECHNICAL FIELD

This invention primarily describes humbucking circuits for odd numbers of matched electro-magnetic string vibration pickups, as used in guitars and basses, also applicable to other musical instruments with ferrous strings, in which each pickup responds equally to external electromagnetic fields, otherwise known a hum; it can also apply to other types of vibration sensors, placed in other manners on other types of equipment which sensors exhibit substantially similar bipolar response to desired and detected signal and to unwanted external electric or magnetic interference.

BACKGROUND AND PRIOR ART

Single-Coil Pickups

Early electromagnetic pickups, such as U.S. Pat. No. 1,915,858 (Miessner, 1933) could have any number of coils, or one coil, as in U.S. Pat. No. 2,455,575 (Fender & Kaufmann, 1948). The first modern and lasting single-coil pickup design, with a pole for each string surrounded by a single coil, seems to be U.S. Pat. No. 2,557,754 (Morrison, 1951), followed by U.S. Pat. No. 2,968,204 (Fender, 1961). This has been followed by many improvements and variations. In all those designs, starting with Morrison's, the magnetic pole presented to the strings is fixed.

Dual-Coil Humbuckers

Dual-coil humbucking pickups generally have coils of equal matched turns around magnetic pole pieces presenting opposite magnetic polarities towards the strings. Lesti, U.S. Pat. No. 2,026,841, 1936, perhaps the first humbucking pickup, had multiple poles, each with a separate coil. Lover, U.S. Pat. No. 2,896,491, 1959, had a single magnet providing the fields for two sets of poles, one for each string, with a coil around each set, the pickup design which most modern humbuckers use. These have been followed by a great many improvements and variations, including: Fender, U.S. Pat. No. 2,976,755, 1961; Stich, U.S. Pat. No. 3,916,751, 1975; Blucher, U.S. Pat. No. 4,501,185, 1985; and Knapp, U.S. Pat. No. 5,292,998, 1994;

Humbucking Pairs

Nunan, U.S. Pat. No. 4,379,421, 1983, patented a reversible pickup that could present either pole to the strings. But the patent only mentions rotating the middle pickup of three to produce two humbucking pairs with the neck and bridge pickups, using a 5-way switching system. It does not present a humbucking pair made with the neck and bridge pickups. Fender, U.S. Pat. No. 4,581,975, 1986, may be the first to use the term "humbucking pairs" (column 2, line 31), stating in column 2, line 19, "Thus, it is common for electrical musical instruments to have two, four or six pick-ups." Yet, in the 3-coil arrangement of his patent, with the middle pickup presenting North poles to the strings and the neck and bridge pickups presenting South poles to the strings, he did not combine the signals from those pickups to form humbucking pairs. Instead, he added dummy pickups between them, underneath the pick guard (FIG. 2), without magnetic poles, for provide the hum signals for cancellation.

Commonly manufacture of single-coil pickups are not necessarily matched. Different numbers of turns, different sizes of wires, and different sizes and types of poles and magnets produce differences in both the hum signal and in the relative phases of string signals. On one 3-coil Fender Stratocaster (tm), for example, the middle and neck coils were reasonably similar in construction and could be balanced. But the bridge coil was hotter, having a slightly different structure to provide a stronger signal from the smaller vibration of the strings near the bridge. Thus in one experiment, even balancing the turns as closely as possible produced a signal with phase differences to the other two pickups, due to differences in coil impedance.

A previous patent (U.S. Pat. No. 9,401,134, 2016, Baker), which supports this invention, used the concept of humbucking pairs and switching systems for four single-coil electromagnetic pickups with coils of equal turns. Baker modified standard single-coil pickups, adding turns until four single-coil pickups have a reasonably equal response to external AC fields, and shocked the magnets of two of them, with a stronger rare-earth magnet, to reverse the poles, providing two matched pickups with North poles toward the strings (N-up) and two matched pickups with South poles toward the strings (S-up). Limited to two 4P5T lever switches, that system had no out-of-phase, or contra-phase, humbucking pairs, but four humbucking pairs and one humbucking quad of parallel-connected pickups on one 5-way switch, and four series-connected pairs with a series-parallel connected quad on the other 5-way switch.

The NP patent application Ser. No. 15/616,396 (Baker, 2017), Humbucking switching arrangements and methods for stringed instrument pickups, extended this invention to humbucking quads, hexes, octets and up, as well as the special case of a humbucking triple. It makes clear that that any electronic switching system for electromagnetic sensors must know which pole is up on each pickup in order to achieve humbucking results. The NP patent application Ser. No. 15/917,389 (Baker, 2018), Single-Coil Pickup with Reversible Magnet & Pole Sensor, presented embodiments of single-coil pickups with magnets that could be removed and reversed, providing as well a signal for the state of the reversal.

For two matched pickups, the humbucker connections, either series or parallel, must be contra-phase if they have the same poles up, and in-phase of they have different poles up. For K number of matched pickups, this makes possible K*(K−1)/2 pair combinations, regardless of poles or series-parallel connections. For example, for four matched pickups A, B, C & D, the unique pair combinations are AB, AC, AD, BC, BD and CD, or 4*3/2=6. If they all have the same pole up, i.e., (N,N,N,N), then all the combinations are contra-phase, and moving any pickup to any other position has no effect. If they have one pole different, i.e., (N,S,S,S), then that pole can be moved to 4 different positions. If they have 2 poles different, i.e., (N,N,S,S), then those poles can be placed uniquely only as (N,N,S,S), (N,S,N,S) and (N,S,S,N), since reversing the poles, i.e., (S,S.N,N), (S,N,S,N) and (S,N,N,S) produce exactly the same in-phase and contra-phase humbucking pair combinations. This total 8 different pole configurations. (See also, https://www.researchgate.net/publication/323686205_Making_Guitars_with_Multiple_Tonal_Characters)

It turns out that if the pickup poles are reversible, for K number of pickups, there can be $2^{K-1}$ different pole configurations, each configuration producing K*(K−1)/2 humbucking pairs, each configuration producing K*(K−1) potentially unique humbucking tones, if both series and parallel pair connections are considered. But all the pole configuration have some common tones. There can be only 2*K*(K−1) potentially unique humbucking tones from the $2^{K-1}$ different pole configurations. For 5 pickups, this is 16 different pole configurations, with 20 potentially unique humbucking pair tones for each configuration, with a total of 40 unique humbucking pair tones for the entire set. For K>7, the number of pole configurations exceeds the number of potentially unique tones.

Even for just humbucking pairs, never mind triples, quads, quintets and hextets, it would be a challenging problem for either electro-mechanical or digitally-controlled pickup switching systems to take full advantage of reversible pickup poles.

Electro-Mechanical Guitar Pickup Switching

The standard 5-way switch (Gagon & Cox, U.S. Pat. No. 4,545,278, 1985) on an electric guitar with 3 single-coil pickups typically provides to the output: the neck coil, the neck and middle coils in parallel, the middle coil, the middle and bridge coils in parallel, and the bridge coil. Typically, the middle pickup has the opposite pole up from the other two, making the parallel connections at least partially humbucking. But while the middle and neck coils have roughly equal numbers of turns, and the bridge coil has more turns than the other two to produce a roughly equal signal from the smaller physical vibrations of the strings nearer the bridge. The standard 3-way switch on a dual-humbucker guitar typically produces the neck, neck||bridge and bridge pickups at the output, all of which are humbucking.

These two switches are "standards" because the vast majority of electric guitars on the market use them. There are other switching systems, such as U.S. Pat. No. 3,290,424, Fender, 1966; U.S. Pat. No. 4,305,320, Peavey, 1981; U.S. Pat. No. 5,136,918, Riboloff, 1992; U.S. Pat. No. 5,311,806, Riboloff, 1994; U.S. Pat. No. 5,763,808, Thompson, 1998; U.S. Pat. No. 6,781,050B2, Olvera, et al., 2004; US2005/0150364A1, Krozack, et al.; U.S. Pat. No. 6,998,529B2, Wnorowski, 2006; and US2009/0308233A1, Jacob. But they are either not on the market, or fill niche positions. In any case, they do not intersect or interfere with the switching systems presented here.

Microcontrollers in Guitar Pickup Switching

Ball, et al. (US2012/0024129A1; U.S. Pat. No. 9,196,235, 2015; U.S. Pat. No. 9,640,162, 2017) describe a "Microprocessor" controlling a "digitally controlled analog switching matrix", presumably one or more solid-state cross-point switches, though that is not explicitly stated, with a wide number of pickups, preamps and controls hung onto those two boxes without much specification as to how the individual parts are connected together to function. According to the Specification, everything, pickups, controls, outputs and displays (if any), passes through the "switching matrix". If this is comprised of just one cross-point switching chip, this presents the problem of inputs and outputs being interrupted by queries to the controls. In the Specification, the patent cites the ability to make "any combination of combinations" without describing or providing a figure any specific one, or even providing a table or scheme describing the set. It states, "On board controls are similar to or exactly the same as conventional guitar/bass controls." But there is not enough information in the patent for someone "with ordinary skill in the art" to either construct or fully evaluate the invention.

The Ball patents make no mention or claim of any connections to produce humbucking combinations. The flow chart, as presented, could just as well be describing analog-digital controls for a radio, or record player or MPEG device. In later marketing (https://www.music-man.com/instruments/guitars/the-game-changer), the company has claimed "over 250,000 pickup combinations" without demonstration or proof, implying that it could be done with 5 coils (from 2 dual-coil humbuckers and 1 single-coil pickup).

Baker (NP patent application Ser. No. 15/616,396, 2017) systematically developed series-parallel pickup topologies from 1 to 5 coils, with 6 coils in notes not included. (See also https://www.researchgate.net/publication/323390784_On_the_Topologies_of_Guitar_Pickup_Circuits) The table labeled Math 12b in that application shows that 5 coils can produce 10717 unique circuits of sizes from 1 to 5 coils, including reversals of individual pickup terminals and moving pickups around the circuit positions. Math 12b shows that 6 coils can produce 286,866 unique circuits of from 1 to 6 coils. "Over 250,000" circuits are possible only with 3 humbuckers, or with 5 coils and a piezoelectric pickup.

Bro and Super, U.S. Pat. No. 7,276,657B2, 2007, uses a micro-controller to drive a switch matrix of electro-mechanical relay switches, in preference to solid-state switches. The specification describes 7 switch states for each of 2 dual-coil humbuckers, the coils designated as 1 and 2: 1, 2, 1+2 (meaning connected in series), 1−2 (in series, out-of-phase), 1||2 (parallel, in-phase), 1||1(−2) (parallel, out-of-phase), 0 (no connection, null output). In Table 1, the same switch states are applied to 2 humbuckers, designated neck and bridge. That is three 7-way switches, for a total number of combinations of $7^3$=343.

In this arrangement, null outputs occur when a series connection is broken. This will happen once for all 3 switches set to null, and each time a series connection in the last switch is broken by a null output in the previous two switches, for a total of at 5 null outputs. Although Super has argued via unpublished e-mail that a reversed output connection is a separate tone, this inventor calls it a duplicate. This can happen when the 7-way output switch is set to parallel and out-of-phase for the second humbucker, the first humbucker 7-way switch is set to null, and the second humbucker 7-way switch is set to any output, or 6 combinations. Taking out 5 nulls and 6 duplicates that leaves 332 useful combinations.

Table 1 in Bro and Super cites 157 combinations, of which one is labeled a null output. For 4 coils, the table labeled Math 12b in Baker, NP patent application Ser. No. 15/616,396, 2017, identifies 620 different combinations of 4 coils, from 69 distinct circuit topologies containing 1, 2, 3 and 4 coils, including variations due to the reversals of coil terminals and the placement of coils in different positions in a circuit. Baker shows how an all-humbucking 20-combination electromechanical switching circuit for two humbuckers produces mean frequencies for 6 strummed strings which have 3 or 4 duplicate tones, with a tendency for mean frequencies to bunch at the warm end of the scale. The use of mean frequency in this manner has not yet been established as a measure of tone, but as a first approximation still raises the question of the practical use of so many tones so close together.

Baker, NP patent application Ser. No. 15/616,396, 2017, demonstrates, in the table labeled Math 31, that the total number of potentially distinct humbucking tones from topologically different electrical circuits of matched guitar pickups, using just simple series-parallel topologies, can be up to 2 for 2 sensors, 6 for 3, 48 for 4, 200 for 5, 3130 for 6 and 19,222 for 7 sensors, up to 394,452 for 8 sensors. Beyond 3 or 4 matched single-coil pickups, electro-mechanical switches are too expensive and impractical. One must us a cross-point matrix or switch of some kind, preferably analog-digital. Baker offered an architecture for a micro-controller system using a solid-state cross-point switch, specifying how the switch is dedicated to sensors, noting that for Mx/2 number of 2-wire sensors, an Mx by (My=Mx+2) crosspoint switch, or larger, will cover all possible interconnections, and provide a 2-wire output. But for humbucking circuits made of matched single-coil pickups, as disclosed in that NPPA, the orientation of the pickup magnetic poles to the strings must be known by the microcontroller. This requires the pickup poles to be manually assigned in the microcontroller switching or programming, or for the microcontroller to directly detect the orientation of the pickup poles. This programming problem has not yet been solved.

Technical Problems to be Solved

Baker (NP patent application Ser. No. 15/616,396, 2017) developed humbucking circuits for matched pickups only in humbucking pairs, quads, hextets, octets and one special case of a humbucking triple. The special case is important because it can be expanded to quintets, septets, nine-tets and up, including series and parallel combinations of humbucking pairs, quads and up with those circuits of odd numbers of matched pickups. This expands the range of possible matched-pickup humbucking circuits to any number of pickups, odd or even. As disclosed in the NPPAs above, there are many more possible non-humbucking series-parallel circuits than humbucking, falling as the number of pickups increase. At 6 pickups, only 1.1% of the possible series-parallel circuits are humbucking pairs, quads and hexes. So far, this inventor knows of no micro-controller algorithm to use with a cross-point switch to pick only humbucking circuits, and is precluded by medical disabilities from developing one.

Having a large, even huge, number of possible circuits and tones to pick from raises the question of how to do the picking, and how to order them from warm to bright and back. Experiments with two humbuckers suggest that tones, as measured by the mean frequency of strummed strings, are much closer together at the warm end than the bright end, and may be so close together that having a large number of possible circuits and tones becomes a matter of diminishing returns. Some method is needed to order and pick tones that are sufficiently distinct to make efficient use of available and invented switching methods, whether electro-mechanical or digitally-controlled.

SUMMARY OF INVENTION—TECHNICAL PROBLEMS RESOLVED

This invention discloses hitherto unknown, non-obvious, beneficial and eminently simple means and methods to solve those problems. It comprises of simple circuits that are constructed and switched according to Four Simple Rules: 1) all of the pickups or sensors are connected to a common point at the pickup terminals that present the same phase of external electro-magnetic interference, or "hum"; 2) at least two pickups must be in the circuit, connected at least one from the common point to the output low terminal, and the other(s) at least one connected from the common point to the output high terminal; and 3) either the common point must be grounded, or the low terminal of the output must be grounded, but not both; and 4) the pickups or sensors must be matched, all having the same response to external hum.

Preferably, but not necessarily, some of the sensors, or pickups, will have desired signal phases that are opposite from one another, with respect to the common connection point. If the signal phases of two sensors are opposite, and one is connected to the high output terminal and the other is connected to the low output terminal, then the signal voltage difference across the output terminals is in-phase. If both sensors have the same signal phase, then the voltage difference across the output terminals is out-of-phase, or contra-phase. It turns out that any number of matched sensors can be connected to the common connection point and the output terminals in this manner, whether by electro-mechanical or digitally-controlled means, and the hum voltages will cancel. Additionally, this kind of circuit can be connected in series or parallel with any other humbucking circuit, and the output will remain humbucking. This greatly expands the number of possible humbucking circuits from pairs, quads, hexes and above, using any even or odd number of sensors.

While this invention was developed primarily for matched single-coil electromagnetic guitar pickups, it has much wider application. It can be applied to any type of sensor which follows the same rules, in any application where matched sensors can be used in this manner to reject external interference.

In the case of an electromagnetic guitar pickup, some effort has been made in the past to connect the outer windings of the coil to ground, so as to provide a kind of shield to electric field noise. But when those pickups are connected in series, this is not possible for all the pickups in the circuit, so that stratagem fails. Only one of the pickups in series can be connected to ground, it any. More often, in better quality pickups, copper or aluminum foil is wrapped about the outside of the coil and grounded. In the case of this invention, where the common connection point is grounded and output is differential, that stratagem succeeds.

Also, many patents and explanatory texts claim that the windings of coil with opposite magnetic polarities are reversed to achieve humbucking. This is not truly necessary; only the terminals of the pickup need be reversed. It makes less manufacturing sense to have two sets of coil winding machines, winding coils in opposite directions. In the case of a grounded common connection point, this invention fully justifies that economy. No terminals need be reversed, only the magnetic field, as described in NP patent application Ser. No. 15/917,389 (Baker, 2018).

BRIEF DESCRIPTION OF THE DRAWINGS

In FIG. 15B, pot $P_{Fab}$ is a two-gang pot, with sections that change equally together.

FIG. 16A shows three 1P2T switches (SWd, SWe, SWf), switching three tone capacitors ($C_{T1}$, $C_{T2}$, $C_{T3}$) to a tone pot ($P_T$), driven by 3 lines of I/O from a micro-controller (uC). The tone circuit is connected across the signal ($V_{S+}$, $V_{S-}$) at the output of a pickup switching system. FIG. 16B shows the same micro-controller and same tone capacitors switching the tone capacitors to a digitally-controlled pot ($P_{TD}$) with 2 lines of uC I/O control going to the switch (SWg), and 3 lines of uC I/O control going to the pot.

DESCRIPTION OF THE INVENTION

Principles of Operation

The principles of operation are mostly mathematical expositions which cannot be patented. But they are necessary to discuss, as they enhance understanding of the material invention, and define the theoretical limits of the invention. Furthermore, they demonstrate that the operation of instruments such as electric guitars have not yet begun to find their limits. They can be a lot more versatile than they are now.

Figures 1A, 1B:
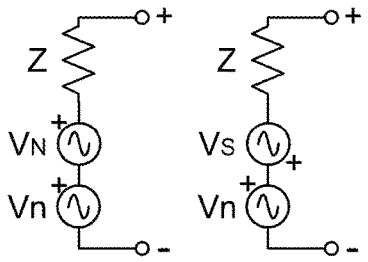
FIGS. 1A-B show a convention for drawing matched vibration sensors in an electronic circuit, including the equal signals from external noise, Vn, the matched sensor impedance, Z, the vibration signal from an N-polarity sensor, $V_N$ (1A), and the vibration signal from a matched S-polarity sensor, $V_S$ (1B), with respect to high (+) and low (−) sensor terminals.

FIG. 1 shows the sign conventions used in this work for matched single-coil electromagnetic guitar pickups, and applies to any other type of sensor which can be manufactured and mounted to comply with the Four Rules described above. FIG. 1A shows the convention for a pickup with a North magnetic field towards the strings (N-up), and FIG. 1B shows a pickup with a South magnetic field towards the strings (S-up). The coil impedance, Z, and response to external noise, Vn, are matched in both pickups, while the signal voltage for the N-up pickup, $V_N$, is the opposite polarity of the signal voltage for the S-up pickup, $V_S$. Note that the pickup terminal polarity is taken to be the same as the external noise signal, Vn.

Figure 2:
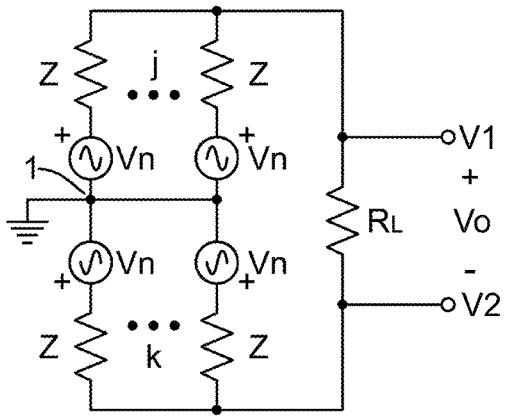
FIG. 2 shows a grounded common connection point (1) with j number of matched sensors connected between it and the high switching output (V1, Vo+), and with k number of matched sensors between the common connection point and the low switching output (V2, Vo−). Only the noise signals are shown, to emphasize that they oppose at the output, which is loaded by a resistance $R_L$.

FIG. 2 shows the generalized circuit, considering only the noise signal, Vn, the same in each pickup, with j number of pickups connected between the grounded common connection point (1) to the high terminal of the output, V1, and k number of pickups connected between the common point and the low output terminal, V2. The differential output voltage, Vo=V1−V2. Math 1 shows the circuit equations and solution, developed in the symbolic math package, Maple V, Release 4.00c, 1996. Thus the circuit is proven to be humbucking, so long as the rules are followed.

Math 1

$$\text{a)}\ \frac{V1 - V2}{R_L} + j\frac{V1 - Vn}{Z} = 0$$

$$\text{b)}\ \frac{V2 - V1}{R_L} + k\frac{V2 - Vn}{Z} = 0$$

$$\text{c)}\ Vo = V1 - V2$$

$$\text{solution)}\ V1 = Vn,\ V2 = Vn,\ Vo = 0.$$

Figure 3:
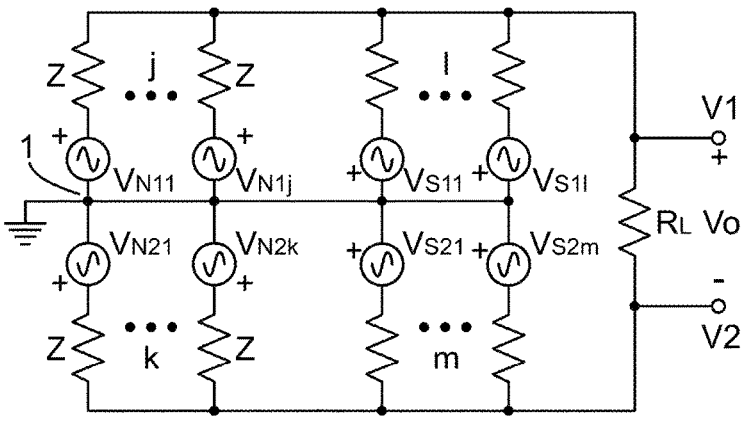
FIG. 3 shows a similar circuit to FIG. 2, with only the vibration signal voltages showing, and with j number of N-up matched sensors between the common connection point (1) and Vo+, k number of N-up sensors between the common connection point and Vo−, 1 number of S-up matched sensors between the common point and Vo+, and m number of S-up sensors between the common point and Vo−, with Vo loaded by resistor, $R_L$.

FIG. 3 shows the generalized circuit, considering only the string vibration signals. The numbers j and k are redefined. Between the grounded common connection point (1) and V1 there are j number of N-up pickups, with signals $V_{N1i}$, i=1 to j, and k number of S-up pickups with signals $V_{S1i}$, i=1 to k. Between the common point and V2 there are 1 number of N-up pickups with signals, $V_{N2i}$, i=1 to 1, and m number of S-up pickups with signals, $V_{S2i}$, i=1 to m. The differential output voltage Vo=V1−V2. Math 2 shows the circuit equations and the solution for Vo. It shows that the N-up pickups on the top are in phase with the S-up pickups on the bottom, but out of phase with the S-up pickups on the top and the N-up pickups on the bottom.

Math 2

$$a)\ \frac{V1-V2}{R_L}+\sum_{i=1}^{j}\frac{V1-V_{N1i}}{Z}+\sum_{i=1}^{k}\frac{V1+V_{S1i}}{Z}=0$$

$$b)\ \frac{V2-V1}{R_L}+\sum_{i=1}^{l}\frac{V2-V_{N2i}}{Z}+\sum_{i=1}^{m}\frac{V2+V_{S2i}}{Z}=0$$

$$c)\ Vo=V1-V2$$

solution)

$$Vo=\frac{1}{j+k}\sum_{i=1}^{j}V_{N1i}-\frac{1}{j+k}\sum_{i=1}^{k}V_{S1i}-\frac{1}{l+m}\sum_{i=1}^{l}V_{N2i}+\frac{1}{l+m}\sum_{i=1}^{m}V_{S2i}.$$

Circuits with Two Coils

With any two coils, (N1,N2), (N1,S1) or (S1,S2), indicating the available coils with either N-up or S-up fields, there is only one possibility, or the single combination of 2 things taken 2 at a time; one coil connects to the high output terminal and the other to the low output terminal. Let the first number represent the upper coil and the second the lower coil. Reversing those connections only changes the sign of the output signal. This inventor contends that this produces no effective difference in tone. Human ears cannot tell the differences in the phase of a signal producing a tone without some other external reference. Therefore, such changes do not count. And going forward, this will in fact reduce the number of choices when the numbers of coils connected to the high and low terminals of the output are equal. Note that when the coils have the same poles up, the switching circuit correctly produces an out-of-phase, or contra-phase, signal, such as N1−N2.

Circuits with Three Coils

Suppose that the three coils can be represented by the designations N1, S1 and N2, for 1 S-up and 2 N-up coils. They can be connected through the switching system to the output terminals as either 2 coils or 3 coils. Table 1 shows various possible circuit/switching combinations. Note that reversing the output terminals produces the duplicates in the right three columns of the table. It does not matter if the circuits are switched this way; it only matters that duplicates are not counted as separate circuits and possible tones. This might be called the Fifth Simple Rule, but it might wait until actual human trials are conducted to confirm it. Call it instead the Rule of Inverted Duplicates.

TABLE 1

Circuit/switching combinations for three coils, N1, S1 and N2, with upper coils connected from the common connection point to the high output terminal, and lower coils connected from the common point to the low output terminal.

| | | | | Duplicates | | |
|---|---|---|---|---|---|---|
| 2 coils | N1 | N1 | S1 | S1 | N2 | N2 |
| | S1 | N2 | N2 | N1 | N1 | S1 |
| 3 coils | N1 | S1 | N2 | S1N2 | N1N2 | N1S1 |
| | S1N2 | N1N2 | N1S1 | N1 | S1 | N2 |

Note that in Table 1, for 2 coils, the results for 2 coils can be explained as (3 things taken 1 at a time) times the number of combinations for 2 coils, or 3*1=3. The results for 3 coils can be taken as (3 things taken 1 at a time)*(2 things taken 2 at a time), or 3*1=3. The combined results for 3 coils, taken in pairs and triples, is 6 humbucking circuits. By Math 2, for the first column of 2 coils, Vo=$V_{N1}$+$V_{S1}$, for the first column of 3 coils, Vo=$V_{N1}$+($V_{S1}$−$V_{N2}$)/2, and for the second column of 3 coil duplicates, Vo=($V_{N1}$+$V_{N2}$)/2+$V_{S1}$. The Rule of Inverted Duplicates also applies to reversals of all the magnetic poles.

It still works for all pickups N-up, N1, N2 and N3, as shown in Table 2, shown without the duplicates. By Math 2, the first column of 2 coil combinations has an output voltage of Vo=$V_{N1}$+$V_{N2}$. The first column of 3 coil combinations has an output voltage of Vo=$V_{N1}$−($V_{N2}$+$V_{N3}$)/2.

TABLE 2

Circuit/switching combinations for three N-up coils, N1, N2 an N3, with upper coils connected from the common connection point to the high output terminal, and lower coils connected from the common point to the low output terminal.

| 2 coils | | 3 coils | | | |
|---|---|---|---|---|---|
| N1 | N1 | N2 | N1 | N2 | N3 |
| N2 | N3 | N3 | N2N3 | N1N3 | N1N2 |

The Rule of Inverted Duplicates also applies to reversals of all the magnetic poles. If Table 1 had instead been constructed of 1 N-up and 2 S-up pickups, S1, N1 and S2, replacing N1, S1, and N2 at their respective positions, the signal voltages at all those positions would simply be reversed. But as NP patent application Ser. No. 15/917,389 (Baker, 2018) demonstrates, the odd pole pickup can be placed in three different physical positions, providing different tonal characters for the entire set.

Circuits with Four Coils

Suppose that we have four matched pickups designated N1, S1, N2 and S2. We can calculate the number of possible outputs for pairs and triples by taking 4 things 2 at a time and 4 things 3 at a time, multiplied by the number of possible pairs (1) and triples (3) without extra pickups. Math 3 shows this calculation.

Math 3

$$\text{Pairs from 4 coils: } \binom{4}{2}*1=\frac{4*3}{2*1}*1=6$$

$$\text{Triples from 4 coils: } \binom{4}{3}*3=\frac{4*3*2}{3*2*1}*3=12.$$

There are 2 ways to arrange 4 coils in a humbucking quad: 1) a single coil in series with (or over) 3 coils in parallel, and 2) 2 coils in parallel, the pair in series with (or over) another 2 coils in parallel. Putting 3 coils in parallel over 1 coil would merely duplicate the first instance by the Rule of Inverted Duplicates. This will be true for any number of pickups J. If we follow the convention of putting the smaller number of pickups over the larger or equal, the number of pickups connected to the high output terminal will range from range from 1 to J/2−1 for J odd, and 1 to J/2 for J even. Table 3 shows the switched combinations for J=4, given 2 N-up pickups N1 and N2, and 2 S-up pickups, S1 and S2.

TABLE 3

| Switching/combinations for 4 coils, N1, S1, N2 and S2 | | | | | | |
|---|---|---|---|---|---|---|
| 1 over 3 | N1<br>N2S1S2 | N2<br>N1S1S2 | S1<br>N1N2S2 | S2<br>N1N2S1 | | |
| Vo = | $V_{N1}$ +<br>$(V_{S1} + V_{S2} - V_{N2})/3$ | $V_{N2}$ +<br>$(V_{S1} + V_{S2} - V_{N1})/3$ | $-V_{S1}$ +<br>$(V_{S2} - V_{N1} - V_{N2})/3$ | $-V_{S2}$ +<br>$(V_{S1} - V_{N1} - V_{N2})/3$ | | |
| | | | | duplicates | | |
| 2 over 2 | N1S1<br>N2S2 | N1N2<br>S1S2 | N1S2<br>S1N2 | S1N2<br>N1S2 | S1S2<br>N1N2 | N2S2<br>N1S1 |
| Vo = | $(V_{N1} - V_{S1})/2$ +<br>$(V_{S2} - V_{N2})/2$ | $(V_{N1} + V_{N2})/2$ +<br>$(V_{S1} + V_{S2})/1$ | $(V_{N1} - V_{S2})/2$ +<br>$(V_{S1} - V_{N2})/2$ | $(V_{N2} - V_{S1})/2$ +<br>$(V_{S2} - V_{N1})/2$ | $(-V_{S1} - V_{S2})/2$ +<br>$(-V_{N1} - V_{N2})/2$ | $(V_{N2} - V_{S2})/2$ +<br>$(V_{S1} - V_{N1})/2$ |

An example of 5 coils can be 2 humbuckers and a single, which a number of guitars on the market have. The number of 1-over-3 combinations can be calculated as (4 things taken 1 at a time) times (3 things taken 3 at a time), or 4*1=4. The number of 2-over2 combinations can be calculated as one-half times (4 things taken 2 at a time) times (2 things taken 2 at a time), or 6*½=3, for a total of 7 humbucking circuits from 4 pickups. Note that when all the terms are collected for the 2-over-2 circuits, Vo for the duplicates is the negative of Vo for the first three, due again to the Rule of Inverted Duplicates. This will happen whenever j=k for j-over-k circuits.

Circuits with 5 Coils

For 5 coils, one can take the previous numbers of tonal circuits calculated for 2, 3 and 4 coils and multiply them by 5 things taken 2, 3 and 4 at a time, plus the number of possibilities for combinations of 5 coils. Unique combinations of 5 coils or pickups in this switching system can be "quint" combinations of 1-over-4 and 2-over-3, without duplicate inversions. Math 4 shows these calculations:

Math 4

$$\text{Pairs from 5 coils: } \binom{5}{2} * 1 = 10 * 1 = 10$$

$$\text{Triples from 5 coils: } \binom{5}{3} * 3 = 10 * 3 = 30$$

$$\text{Quads from 5 coils: } \binom{5}{4} * 7 = 5 * 7 = 35$$

$$\tfrac{1}{4}\text{ Quints from 5 coils: } \binom{5}{1} * \binom{4}{4} = 5 * 1 = 5$$

$$\tfrac{2}{3}\text{ Quints from 5 coils: } \binom{5}{2} * \binom{3}{3} = 10 * 1 = 10$$

Total tonal circuits from 5 coils = 10 + 30 + 35 + (5 + 10) = 90.

Circuits with 6 Coils

A number of guitars on the market have three humbuckers, which can be considered 6 matched pickups for this discussion. Math 5 shows these calculations. Not the reduction of 3-over-3 hextets due to the Rule of Inverted Duplicates.

Math 5

$$\text{Pairs from 6 coils: } \binom{6}{2} * 1 = 15 * 1 = 15$$

-continued $$\text{Triples from 6 coils: } \binom{6}{3} * 3 = 20 * 3 = 60$$

$$\text{Quads from 6 coils: } \binom{6}{4} * 7 = 15 * 7 = 105$$

$$\text{Quints from 6 coils: } \binom{6}{5} * 15 = 6 * 15 = 90$$

$$\tfrac{1}{5}\text{ Hexes from 6 coils: } \binom{6}{1} * \binom{5}{5} = 6 * 1 = 6$$

$$\tfrac{2}{4}\text{ Hexes from 6 coils: } \binom{6}{2} * \binom{4}{4} = 15 * 1 = 15$$

$$\tfrac{3}{3}\text{ Hexes from 6 coils: } \tfrac{1}{2}\binom{6}{3} * \binom{3}{3} = \tfrac{1}{2} 20 * 1 = 10$$

Total tonal circuits from 6 coils =

$$15 + 60 + 105 + 90 + (6 + 15 + 10) = 301.$$

Fender (U.S. Pat. No. 3,290,424, 1966) managed to put 8 sets of poles under a pick guard, which arguably could have been 8 pickups. Whether or not it would be useful is another matter. For stringed instruments like pianos, where many more pickup coils can be used along the strings, the method of calculating the number of possible humbucking circuits can be easily expanded by the same rules. So for 2, 3, 4, 5, 6, 7, 8, 9 and 10 matched pickup coils, this switching system can produce, respectively, 1, 6, 25, 90, 301, 966, 3025, 9330 and 28,501 humbucking circuits. The natural logs of the number of HB circuits, NHB, are about: 0, 1.79, 3.22, 4.50, 5.70, 6.87, 8.01, 9.14 and 10.26. So the rise in the number of circuits is clearly an exponential function of the number of pickups.

TABLE 4

Numbers of circuits for K pickups taken J at a time in a common connection point switching circuit.

| | J = | | | | | | | | | | | |
|---|---|---|---|---|---|---|---|---|---|---|---|---|
| K | 2 | 3 | 4 | 5 | 6 | 7 | 8 | 9 | 10 | 11 | 12 | Totals |
| 2 | 1 | | | | | | | | | | | 1 |
| 3 | 3 | 3 | | | | | | | | | | 6 |
| 4 | 6 | 12 | 7 | | | | | | | | | 25 |
| 5 | 10 | 30 | 35 | 15 | | | | | | | | 90 |
| 6 | 15 | 60 | 105 | 90 | 31 | | | | | | | 301 |
| 7 | 21 | 105 | 245 | 315 | 217 | 63 | | | | | | 966 |
| 8 | 28 | 168 | 490 | 840 | 868 | 504 | 127 | | | | | 3025 |
| 9 | 36 | 252 | 882 | 1890 | 2604 | 2268 | 1143 | 255 | | | | 9330 |
| 10 | 45 | 360 | 1470 | 3780 | 6510 | 7560 | 5715 | 2550 | 511 | | | 28501 |
| 11 | 55 | 495 | 2310 | 6930 | 14322 | 20790 | 20955 | 14025 | 5621 | 1023 | | 86526 |
| 12 | 66 | 660 | 3465 | 11880 | 28644 | 49896 | 62865 | 56100 | 33726 | 12276 | 2047 | 261625 |

Table 4 shows these calculations for this kind of circuit extended to K pickups taken J at a time, where K=2 to 12 and J=2 to 12. The first thing that becomes apparent is that for J pickups taken J at a time, the number of circuits is $2^{(J-1)}-1$. Math 6 shows the full equation. This determines the upper limit of switched circuits of this type.

$$\#\text{Circuits for } K = J\text{: } 2^{J-1} - 1,\ J \geq 2 \qquad \text{Math 6}$$

$$\#\text{Circuits for } K > J\text{: } (2^{J-1} - 1)\binom{K}{J},\ J \geq 2$$

$$\text{Total } \#\text{Circuits for } K \geq 3,\ J \geq 2,\text{: } (2^{J-1} - 1) * \left(1 + \sum_{J=2}^{K-1} \binom{K}{J}\right).$$

Hybrid Humbucking Circuits

Using matched pickups, common connection point humbucking circuits can be combined in series and parallel with the kind of series-parallel humbucking circuits disclosed in NP patent application Ser. No. 15/616,396 (Baker, 2017), and the result will still be humbucking. Thus humbucking quintets can be constructed by placing humbucking pairs in series and in parallel with a humbucking triple. Humbucking septets can be formed by placing humbucking quads in series with humbucking triples, and by placing humbucking pairs in series and parallel with humbucking pairs. Humbucking nine-tets can be formed by placing humbucking sextets in series and parallel with humbucking triples, by placing humbucking quints in series and parallel with humbucking quads, and by placing humbucking septets in series and parallel with humbucking pairs.

This is less a matter of constructing new circuits than expanding the number of humbucking circuits that can be obtained by replacing unmatched pickups with matched pickups in all series-parallel circuits. In general, hybrid humbucking circuits cannot take advantage of the Four Simple Rules for the switching system disclosed here.

The Number of Possible Tones with Reversible Pickup Poles

NP patent application Ser. No. 15/917,389 (Baker, 2018) shows that for J number of matched pickups with reversible poles, there are $2^{J-1}$ possible pole configurations: 2 configurations for 2 pickups, 4 for 3 pickups, 8 for 4 pickups, 16 for 5 pickups, and so forth. Suppose the one has matched pickups with reversible poles in positions A, B, C, D, . . . , where A is N-up and A' is S-up. Each position picks up fundamentals and harmonics of vibration that are at least slightly different in tonal content. How many different circuit-pole combinations have possibly different tones? For 2 pickups, there is only 1 circuit with 2 possibilities, A+B' and A−B, where A, B and B' also stand in for the signal voltages.

For 3 pickups, there are 4 pole position configurations: (A,B,C), (A',B,C), (A,B',C) and (A,B,C'). Table 5 shows the results. The first pickup in the pole position sequence is assumed to be connected between the common connection point and the high output terminal. For humbucking pairs, there are only 6 possible tonal differences, because of duplicates, like A-B, and the Rule of Inverted Duplicates, i.e., −A'−B=A+B'. To look at it another way, there are only unique three pairs, and A±B allows for 2 choices, or 3*2=6. For any pole configuration, there are 3 switched pairs, each of which produces a set of 3 potentially unique tones out of 6. The lower half of Table 5 shows how a 1-over-2 humbucking triple produces 3 possible triples with 12 possible tones. The possibilities go as A±(B±C)/2, or $2^2$=4 sign choices, and 3 circuit choices for 3*4=12 unique circuits with potentially unique tones. We must say "possible tones", or "potentially unique tones", because the following experiment with two humbuckers demonstrates that some tonal results can be very close together. So for 3 pickups, we have 18 potentially unique tones, from 4 different pole configurations, each of which has 6 switched circuits with a set of 6 of those 18 potentially unique tones.

TABLE 5

Possible different tonal circuits for 3 matched pickups, where A means a N-up pickup and A' means a S-up pickup

| | A, B, C | A', B, C | A, B', C | A, B, C' | |
|---|---|---|---|---|---|
| A&B | A − B | −A ' − B | A + B' * | A − B * | 3 out of |
| A&C | A − C | −A' − C | A − C * | A + C' ** | 6 possible |
| B&C | B − C | B − C * | −B' − C | B + C' ** | |

TABLE 5-continued

| Possible different tonal circuits for 3 matched pickups, where A means a N-up pickup and A' means a S-up pickup | | | | | |
|---|---|---|---|---|---|
| | A, B, C | A', B, C | A, B', C | A, B, C' | |
| A&(B&C)/2 | A + (−B − C)/2 | −A' + (−B − C)/2 | A + (B' − C)/2 | A + (−B + C')/2 | 3 out of |
| B&(A&C)/2 | B + (−A − C)/2 | B + (A' − C)/2 | −B' + (−A − C)/2 | B + (−A + C')/2 | 12 possible |
| C&(A&B)/2 | C + (−A − B)/2 | C + (A' − B)/2 | C + (−A + B')/2 | −C' + (−A − B)/2 | |

* duplicate,
** inverted output duplicate

We can see that for 4 pickups, with four 1-over-3 circuits and three 2-over-2 circuits, changing the pole configurations can only change the signal phases as A±(B±C±D)/3 and (A±B)/2±(C±D)/2, or $2^3$=8 signal sign configurations. That means 7*8=56 potentially unique tones, plus those for 4 pickups taken 2 and 3 at a time. In general, if we have K number of pickups, with $2^{K-1}$ number of pole configurations, we can have signal phase changes at different positions that go as A±B±C± . . . ±K or $2^{K-1}$ possible phase changes for each possible circuit, regardless of where the parentheses and divisors go to fit the solution in Math 2. We cannot count ±A±B±C± . . . ±K, or $2^K$ possible phase changes, because of the Rule of Inverted Duplicates.

For humbucking pairs with 4 pickups, we have [4 pickups taken 2 at a time]=6 pair combinations, times $[2^{(2-1)}-1]$=1 circuits, times $2^{(2-1)}$=2 phase changes, or 6*2=12 potentially unique tones. For humbucking triples with 4 pickups, we have [4 pickups taken 3 at a time]=4 triple combinations, times $[2^{(3-1)}-1]$=3 circuits, times $2^{(3-1)}$=4 phase changes, or 4*3*4=48 potentially unique tones. This gives a total of 12+48+56=116 potentially unique tones, from 8 different pole configurations, each of which has a set of 25 switched circuits, each of which has a set of 25 of those 116 potentially unique tones.

Math 7

$$N_{tones} = \sum_{J=2}^{K-1} \binom{K}{J} (2^{J-1} - 1)(2^{J-1}).$$

Math 7 shows the total number of tones for K number of matched and reversible pole single-coil pickups, for circuits of J=1 to K. The first term in the summation is the number of circuits of K pickups taken J at a time; the second term is the number of common-point switched circuits for J pickups; and the third term is the number of pickup sign changes obtained by changing poles in J pickup positions. Table 6 shows the results of this equation in the Totals column on the right. The first header row is J; the second is the number of the number of pole configurations and pickup signal sign changes for J pickups; and the third is the number of unique circuits for J pickups in a common connection point switching circuit. The Totals column represents the total number of potentially unique tones possible for K pickups in circuits of size J=2 to K.

TABLE 6

Number of potentially unique tones for K matched and pole-reversible single-coil pickups for circuits of J = 2 to K pickups.

| | J # in Ckt | | | | | | | | | |
|---|---|---|---|---|---|---|---|---|---|---|
| | 2 | 3 | 4 | 5 | 6 | 7 | 8 | 9 | 10 | |
| | | | | | | $2^{(J-1)}$ | | | | |
| | 2 | 4 | 8 | 16 | 32 | 64 | 128 | 256 | 512 | |
| | | | | | | $2^{(J-1)} - 1$ | | | | |
| K # pickups | 1 | 3 | 7 | 15 | 31 | 63 | 127 | 255 | 511 | Totals |
| 2 | 2 | | | | | | | | | 2 |
| 3 | 6 | 12 | | | | | | | | 18 |
| 4 | 12 | 48 | 56 | | | | | | | 116 |
| 5 | 20 | 120 | 280 | 240 | | | | | | 660 |
| 6 | 30 | 240 | 840 | 1440 | 992 | | | | | 3542 |
| 7 | 42 | 420 | 1960 | 5040 | 6944 | 4032 | | | | 18438 |
| 8 | 56 | 672 | 3920 | 13440 | 27776 | 32256 | 16256 | | | 94376 |
| 9 | 72 | 1008 | 7056 | 30240 | 83328 | 145152 | 146304 | 65280 | | 478440 |
| 10 | 90 | 1440 | 11760 | 60480 | 208320 | 483840 | 731520 | 652800 | 261632 | 2411882 |

TABLE 7

Compilation of results of Tables 4 and 6, showing the number of pole configurations, total number of common connection point switching circuits and total number of potentially unique tones for K pickups, and all circuits from J = 2 to K.

| K # pickups | # pole config | # switch ckts | # tones |
|---|---|---|---|
| 2 | 2 | 1 | 2 |
| 3 | 4 | 6 | 18 |
| 4 | 8 | 25 | 116 |
| 5 | 16 | 90 | 660 |
| 6 | 32 | 301 | 3542 |
| 7 | 64 | 966 | 18438 |
| 8 | 128 | 3025 | 94376 |
| 9 | 256 | 9330 | 478440 |
| 10 | 512 | 28501 | 2411882 |

Table 7 is self-explanatory. All the other columns tend to rise exponentially with K. There are always fewer tones per circuits than there are pole configurations. All tones are potentially unique until proven so. No more than about 9 standard-size single-coil pickups can fit in between the neck and bridge of a standard length six-string electric guitar. But there will be diminishing returns with the increasing number of pickups, since having coils close together reduces the differences in harmonic differences they see from a vibrating string. Plus their magnetic fields tend to interfere, and they also become weak transformers when side-by-side. Five or six may be the practical limit. Ten matched pickups is likely practical only on un-fretted instruments of much larger scale, such as pianos. Or, if the principles can be applied to piezo-electric and other vibration pickups, to instruments such as drums and horns. In any case, these limits extend far beyond standard 3-way and 5-way switches.

An Experiment with Two Mini-Humbuckers

Figure 4:
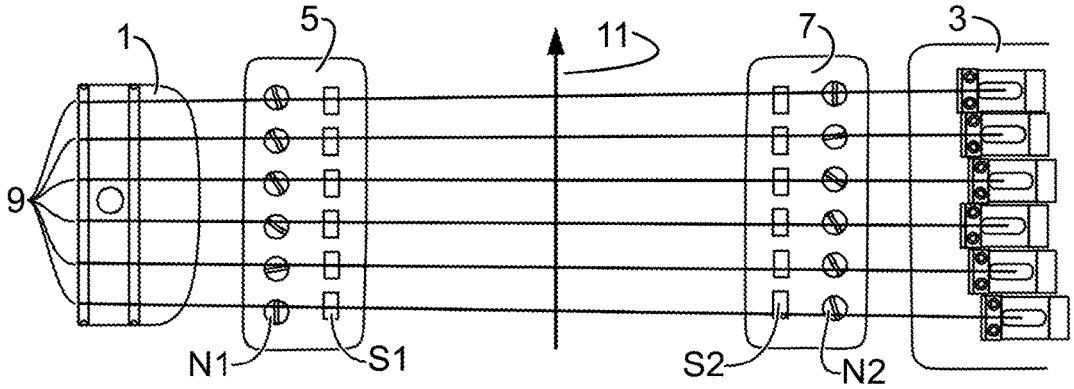
FIG. 4 shows the physical setup for a two-humbucker experiment, with the one mini-humbucker (5) at the neck (1), with adjustable N-up screw poles (N1) and S-up non-adjustable flat poles (S1), another reasonably-matched humbucker of the same model (7), with reasonably matching characteristics, at the bridge (3), with N-up screw poles (N2) and S-up flat poles (S2), showing the position and direction of strumming used on all six strings (11).

FIG. 4 shows the neck (1) to bridge (3) region on an electric guitar with two generic Hofner-style mini-humbuckers (5&7) installed under the strings (9). The neck pickup (5) and the bridge pickup (7), have one set of adjustable screw poles for the N-up poles, (N1) and (N2), with hemi-spherical heads that extend above the pickup cover, and one set of rectangular S-up poles, (S1) and (S2), that sit flush with the cover. Since both pickups are the same model number, the coils are reasonably matched in response to external hum. The strings are tuned to the standard E-A-D-G-B-E, and were strummed midway between the pickups at (11). For reference, Table 8 shows the string fundamental and harmonic frequencies.

TABLE 8

String fundamental frequencies and harmonics for standard EADGBE tuning (Hz)

| | String fund | 2nd harm | 3rd harm | 4th harm | 5th harm | 6th harm | 7th harm | 8th harm |
|---|---|---|---|---|---|---|---|---|
| E | 82.4 | 164.8 | 247.2 | 329.6 | 412 | 494.4 | 576.8 | 659.2 |
| A | 110.0 | 220.0 | 330.0 | 440.0 | 550 | 660 | 770 | 880 |
| D | 146.8 | 293.6 | 440.4 | 587.2 | 734 | 880.8 | 1027.6 | 1174.4 |
| G | 196.0 | 392.0 | 588.0 | 784.0 | 980 | 1176 | 1372 | 1568 |
| B | 246.9 | 493.8 | 740.7 | 987.6 | 1234.5 | 1481.4 | 1728.3 | 1975.2 |
| E | 329.6 | 659.2 | 988.8 | 1,318.4 | 1648 | 1977.6 | 2307.2 | 2636.8 |

Figure 5:
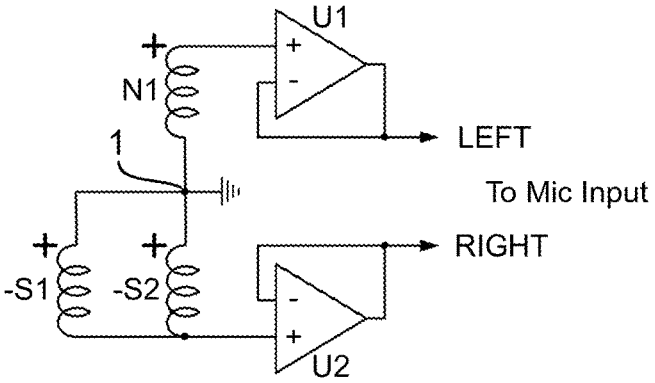
FIG. 5 shows a representative test setup for the common connection point (1) system to get a Fast Fourier Transform (FFT) magnitude spectrum from the N-up matched pickup (N1) indicated in FIG. 4 connected between the common point and the left microphone input (LEFT) of a desktop computer, through a voltage-follower amp (U1), and from the two S-up matched pickups (S1 & S2) connected between the common point and the right mic input (RIGHT) through a voltage follower (U2).

FIG. 5 shows a humbucking triple using coils N1, S1 and S2, with a common connection point (1), and two voltage follower preamplifiers, U1 and U2. The output of U1 represents the high output terminal, going to the left microphone channel of the mic input of a desktop PC. The output of U2 represents the low output terminal, going to the right microphone channel. All of the 25 circuit combinations were tested. A shareware program, Simple Audio Spectrum Analyzer v3.9, © W. A. Sterr 2001-2006, SpecAn_3v97c.exe, digitized the signal and produced a magnitude-only FFT spectrum for the mic signal Vo/2=(Left-Right)/2. It took Hann (raised cosine) windows of 4096 values at a rate of 8000 samples per second, providing a frequency resolution of about 2 Hz, over a range from 0 to 3998 Hz. It averaged all the windows together to produce a discrete FFT spectrum, measured as dB full scale (dBFS) versus frequency, exported into a *.CSV text file and imported into MS Excel for processing.

Math 8 shows the equations used to process this FFT data in a spreadsheet. There are 2048 magnitude values in the dBFS scale for frequency bins from 0 to 3998 Hz, with a resolution of about 1.95 Hz. These are converted to linear values, linVn(fn), which are summed to obtain the relative signal amplitude. Dividing each magnitude by the total provides a probability density function, Pv(fn), which sums to 1. Multiplying and summing over the product of all the bin frequencies and the density function values gives the mean frequency in Hz. The second and third moments of the FFT spectrum are the bin frequency minus the mean, raised to the second and third powers, times the density function. For the purpose of simply maintaining smaller and more comparative numbers to consider the second and third roots of the second and third moments have units of Hz.

Math 8

$$linV_n(f_n) = 10^{dBFS_n/20},\ 1 <= n <= 2048$$

$$\text{Relative signal amplitude} = \sum_{n=1}^{2048} linV_n$$

$$P_V(f_n) = \frac{linV_n}{\sum_{n=1}^{2048} linV_n}$$

$$\text{mean}\cdot f = \sum_{n=1}^{2048} f_n * P_V(f_n)$$

$$2nd\cdot\text{moment}\cdot f = \sum_{n=1}^{2048} (f_n - \text{mean}\cdot f)^2 * P_V(f_n)$$

-continued $$3rd\cdot\text{moment}\cdot f = \sum_{n=1}^{2048} (f_n - \text{mean}\cdot f)^3 * P_V(f_n).$$

Table 9 shows the results of this experiment for the 25 HB circuits from the 4 coils in FIG. 4. The designation "o" between the pole designations means "over", as in N1*o*S1, means that the N1 signal is connected to the Left or high output in FIG. 5, and −S1 signal is connected to the Right or low output in, providing the measured output signal, Vo/2=(Left−Right)/2=$(V_{N1}+V_{S1})/2$. Likewise, S1*o*N1N2S2 indicates that the $-V_{S1}$ signal is connected to the high output, and the parallel connection of the signals $V_{N1}$, $V_{N2}$ and $-V_{S2}$ signals are connected to the low output, providing a measured signal of Vo/2=(Left−Right)/2=$(-V_{S1}+(V_{S2}-V_{N1}-V_{N2})/3)/2$. Hereafter, when the measured results are converted from dBFS to linear, the linear results are multiplied by 2, and the "/2" is dropped. The relative amplitudes in Table 9 have been multiplied by 2 after calculation to get the correct value of Vo.

TABLE 9

HB circuits from 4 coils, w/relative signal amplitudes and root moments

| Coils | Relative Signal Amplitude | Moments (Hz) 1st | Root-2nd | Root-3rd |
|---|---|---|---|---|
| N1oS1 | 2.83 | 636.1 | 684.2 | 1224.3 |
| N1oN2 | 1.15 | 843.0 | 752.3 | 1387.5 |
| N1oS2 | 2.05 | 713.5 | 722.7 | 1295.3 |
| S1oN2 | 2.31 | 770.5 | 740.1 | 1337.7 |
| S1oS2 | 0.88 | 835.0 | 752.8 | 1380.1 |
| N2oS2 | 2.59 | 907.5 | 771.0 | 1440.7 |
| N1oS1N2 | 0.78 | 933.1 | 794.6 | 1474.9 |
| N1oN2S2 | 0.23 | 1201.1 | 873.1 | 1724.2 |
| N1oS1S2 | 2.59 | 669.8 | 717.1 | 1275.0 |
| S1oN1S2 | 1.91 | 655.1 | 704.8 | 1252.0 |
| S1oN2S2 | 1.33 | 637.4 | 687.4 | 1226.4 |
| S1oN1N2 | 2.23 | 672.2 | 704.6 | 1259.0 |
| N2oN1S1 | 0.31 | 849.3 | 824.7 | 1468.2 |
| N2oN1S2 | 0.74 | 712.6 | 718.1 | 1288.1 |
| N2oS1S2 | 2.18 | 792.8 | 752.8 | 1363.7 |
| S2oN1S1 | 0.36 | 837.2 | 822.7 | 1454.7 |
| S2oN2S1 | 1.30 | 683.4 | 714.9 | 1274.3 |
| S2oN1N2 | 2.64 | 792.9 | 754.2 | 1362.3 |
| N1oS1N2S2 | 0.40 | 633.2 | 708.9 | 1247.4 |
| S1oN1N2S2 | 0.63 | 632.9 | 699.4 | 1235.3 |
| N2oN1S1S2 | 0.26 | 854.7 | 756.4 | 1398.3 |
| S2oN1S1N2 | 0.49 | 827.6 | 783.5 | 1413.4 |
| N1N2oS1S2 | 2.55 | 741.4 | 743.2 | 1329.1 |
| N1S2oS1N2 | 1.02 | 837.0 | 750.1 | 1379.9 |
| N1S1oN2S2 | 0.25 | 1006.8 | 868.2 | 1598.4 |

TABLE 10

25 results ordered by mean frequency from low to high

| Coils | Relative Linear Signal Amplitude | Moments (Hz) 1st | Root-2nd | Root-3rd |
|---|---|---|---|---|
| S1oN1N2S2 | 0.63 | 632.9 | 699.4 | 1235.3 |
| N1oS1N2S2 | 0.40 | 633.2 | 708.9 | 1247.4 |
| N1oS1 | 2.83 | 636.1 | 684.2 | 1224.3 |
| S1oN2S2 | 1.33 | 637.4 | 687.4 | 1226.4 |
| S1oN1S2 | 1.91 | 655.1 | 704.8 | 1252.0 |
| N1oS1S2 | 2.59 | 669.8 | 717.1 | 1275.0 |
| S1oN1N2 | 2.23 | 672.2 | 704.6 | 1259.0 |
| S2oN2S1 | 1.30 | 683.4 | 714.9 | 1274.3 |
| N2oN1S2 | 0.74 | 712.6 | 718.1 | 1288.1 |
| N1oS2 | 2.05 | 713.5 | 722.7 | 1295.3 |
| N1N2oS1S2 | 2.55 | 741.4 | 743.2 | 1329.1 |
| S1oN2 | 2.31 | 770.5 | 740.1 | 1337.7 |
| N2oS1S2 | 2.18 | 792.8 | 752.8 | 1363.7 |
| S2oN1N2 | 2.64 | 792.9 | 754.2 | 1362.3 |
| S2oN1S1N2 | 0.49 | 827.6 | 783.5 | 1413.4 |
| S1oS2 | 0.88 | 835.0 | 752.8 | 1380.1 |
| N1S2oS1N2 | 1.02 | 837.0 | 750.1 | 1379.9 |
| S2oN1S1 | 0.36 | 837.2 | 822.7 | 1454.7 |
| N1oN2 | 1.15 | 843.0 | 752.3 | 1387.5 |
| N2oN1S1 | 0.31 | 849.3 | 824.7 | 1468.2 |
| N2oN1S1S2 | 0.26 | 854.7 | 756.4 | 1398.3 |
| N2oS2 | 2.59 | 907.5 | 771.0 | 1440.7 |
| N1oS1N2 | 0.78 | 933.1 | 794.6 | 1474.9 |
| N1S1oN2S2 | 0.25 | 1006.8 | 868.2 | 1598.4 |
| N1oN2S2 | 0.23 | 1201.1 | 873.1 | 1724.2 |

Figure 6:
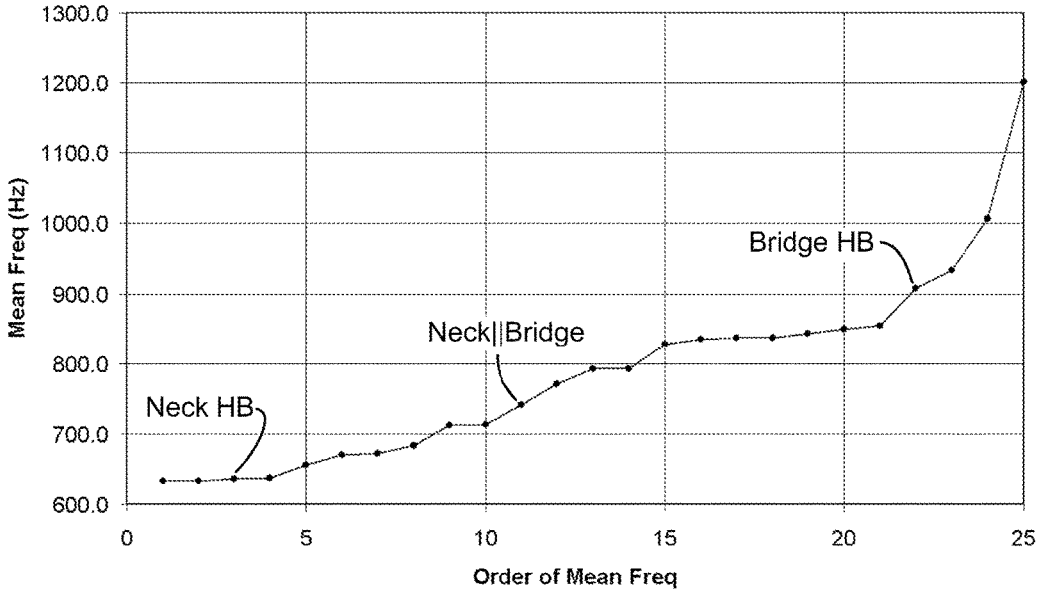
FIG. 6 shows the plot of mean frequencies of the FFT spectra, developed by the experiment in FIG. 5 for the 25 combinations of pickup circuits, using common connection point switching, ordered from low to high, with the roughly equivalent frequencies of a standard 3-way switch on a dual-humbucker guitar, marked as Neck HB, Neck||Bridge, and Bridge HB.

Table 10 shows the same results, ordered by the $1^{st}$ moment, which is the mean frequency of the spectral analysis, with a range from 632.9 to 1201.1 Hz. FIG. 6 shows the same results for mean frequency versus frequency order. It highlights the equivalent 3-way switch results, the neck humbucker (Neck HB) at the $3^{rd}$ spot, 636.1 Hz, the neck and bridge humbuckers in parallel (Neck||Bridge) at the $11^{th}$ spot, 741.4 Hz, and the bridge humbucker (Bridge HB) at the $22^{nd}$ spot, 907.5 Hz. It shows a number of frequencies bunched closely together, at 632.9 to 639.4 Hz, 669.8 and 672.2 Hz, 712.6 and 713.5 Hz, 792.8 and 792.9 Hz, and from 835.0 to 837.2 Hz. Note that the four results above 854.7 Hz have a much steeper curve, and the top three have a lower signal strength, and that the results in general tend to be bunched at the low end, at the presumably warmer tones, and again in the middle-high range between 800 and 900 Hz. Without having done the measurements, one can only speculate that the distribution may have be more even for four matched and evenly spaced pickups, as described in U.S. Pat. No. 9,401,134 (Baker, 2016).

This suggests that there may be only 17 distinct tones available, a result consistent with a two-humbucker experiment in NP patent application Ser. No. 15/616,396 (Baker, 2017) using a 20-circuit switch. Note also that the relative signal strengths run from 0.23 to 2.83, a factor of 12.3, or about 22 dB. This data will be used to demonstrate a method for ordering tones and choosing switching connections accordingly, with variable gains to equalize signal strengths.

Embodiments of Electro-Mechanical Switching Systems

For 3 unmatched single-coil pickups, there are 47 different series-parallel circuits. For 3 matched single-coil pickups, there are 6 different humbucking series-parallel pairs, plus 3 humbucking triples for a total of 9 different humbucking circuits. For 4 unmatched single-coil pickups, there are 620 different series-parallel circuits. For 2 humbuckers with 4 matched coils, there are 20 series-parallel arrangements, considering only the internal humbucker series-parallel connections and the external humbucker to humbucker series-parallel connections. For 4 matched single-coil pickups, there are 48 combinations of humbucking pairs and quads, with 12 humbucking triples and 4 humbucking circuits with one pickup over three, for a total of 64 different humbucking circuits. The humbucking circuits with 2 over 2 pickups duplicate humbucking quads already constructed.

The simplicity of the circuits disclosed here, using the Four Simple Rules, reduces the number of humbucking circuits from 9 to 6 for 3 matched pickups, and from 64 to 25 humbucking circuits for 4 matched single-coil pickups. This, in exchange for simplified switching that can be ordered according to the warmth (or at least the mean frequency) of humbucking tones. This switching system can be achieved with a number of different embodiments, from those using available mechanical switches, to those with both mechanical switches and active amplifiers, to those with microprocessor-controlled switching and gains. As the following examples show, there are a wide number of possible embodiments, not limited to just those depicted here.

Embodiment 1: 3 Matched Coils with a 4P6T Switch

Figure 7:
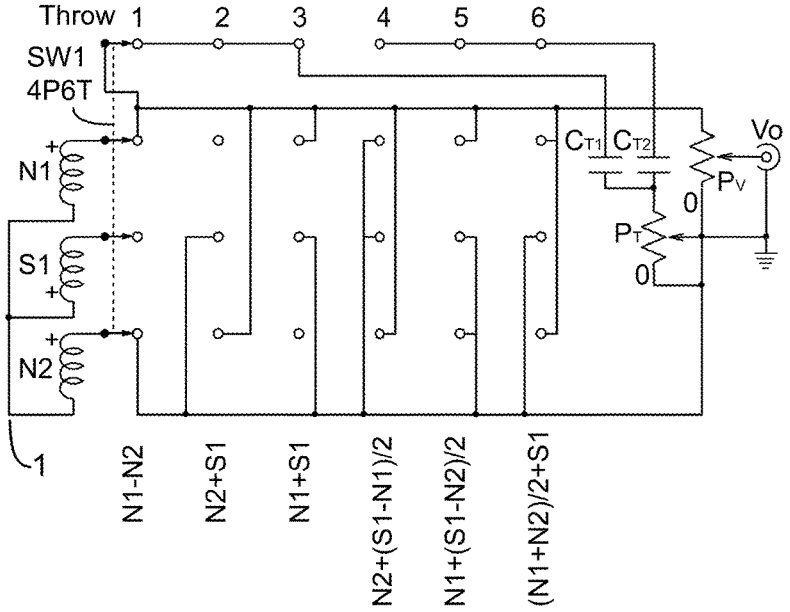
FIG. 7 shows a 4 pole 6 throw (SW1) switching circuit using an ungrounded common connection point (1) with two N-up electromagnetic coil matched pickups (N1 & N2) and a matched S-up pickup (S1), where three poles and throws of the switch make all 6 combinations of the pickups in the order N1−N2, N2+S1, N1+S1, N2+(S1−N1)/2, N1+(S1−N2)/2 and (N1+N2)/2+S1, where the pickup designations also represent their vibration signals, with the $4^{th}$ pole and throws switching the tone capacitors $C_{T1}$ and $C_{T2}$ to the tone pot $P_T$, the output connected to the volume pot, $P_V$, with a single-ended output, Vo, referenced to ground.

In FIG. 7, as is common, dots at line crossings show connections and crossing without dots are pass-overs, as with the lines above $C_{T1}$ and $C_{T2}$. The pickups coils N1 and N2 are N-up, with the negative terminals connected in common with the positive terminal of S1, an S-up coil, at the common connection point (1). Note that only 3 of the 4 poles are needed to make the connections. Which follow the humbucking rule of having at least one coil connected to each side of the output, high and low. The $4^{th}$ pole can either be used for tone capacitors to match the circuit lumped inductance, as shown, or for gain control resistors, if the switched output goes into an amplifier. Note the signals listed below each throw (1 to 6), N1−N2, N2+S1, N1+S1, N2+(S1−N1)/2, N1+(S1−N2)/2, and (N1+N2)/2+S1, respectively.

If each of the matched coils have inductance, $L_C$, then the first three throws have circuit with a lumped inductance of $2*L_C$, and the last three have a lumped inductance of $3*L_C/2$. Tone capacitors $C_{T1}$ and $C_{T2}$ can be used to maintain the equal effect of the tone pot, $P_T$, on tone. Since resonance frequency is a function of the product of inductance and capacitance, the products, $2*L_C*C_{T1}$ and $3*L_C*C_{T2}/2$ must be equal to achieve similar tone results, implying that $C_{T1}=3*C_{T2}/4$. Both the tone circuit and the volume pot, $P_V$, lie across the output of the switching circuit. The wiper of the volume pot is connected to the output, Vo.

This is not the only possible selection of matched coils. They could all be either all S-up or all N-up. In which case, all the outputs would be humbucking but out-of-phase, or contra-phase. Without amplification and signal equalization, the output signals would be much weaker, but much brighter. A selection of matched coils that has only one S-up, as shown here, and a selection that has only one N-up will produce the same tones if the opposite poles from each set occupy the same positions under the strings. In other words, N-S-N is the same as S-N-S. In the case of N-S-N, the physical positioning of the S-up pole under the strings will also determine tone, with different sets of tones from S-N-N and N-N-S.

If the pickup magnetic poles are reversed to change the tonal character of the guitar, each pole change will affect both the frequency and order of tones. The order of tones for the switch wiring for one set of poles likely will not hold for another. So there must be some way to change the wiring of the switching along with changing the poles to at least keep an order of tone monotonic from warm to bright. U.S. Pat. No. 9,401,134 (Baker, 2016) disclosed such a device in FIG. 30, a plug-in board with cross-points to be soldered with through-hole jumpers to set the switch connections.

Figure 8:
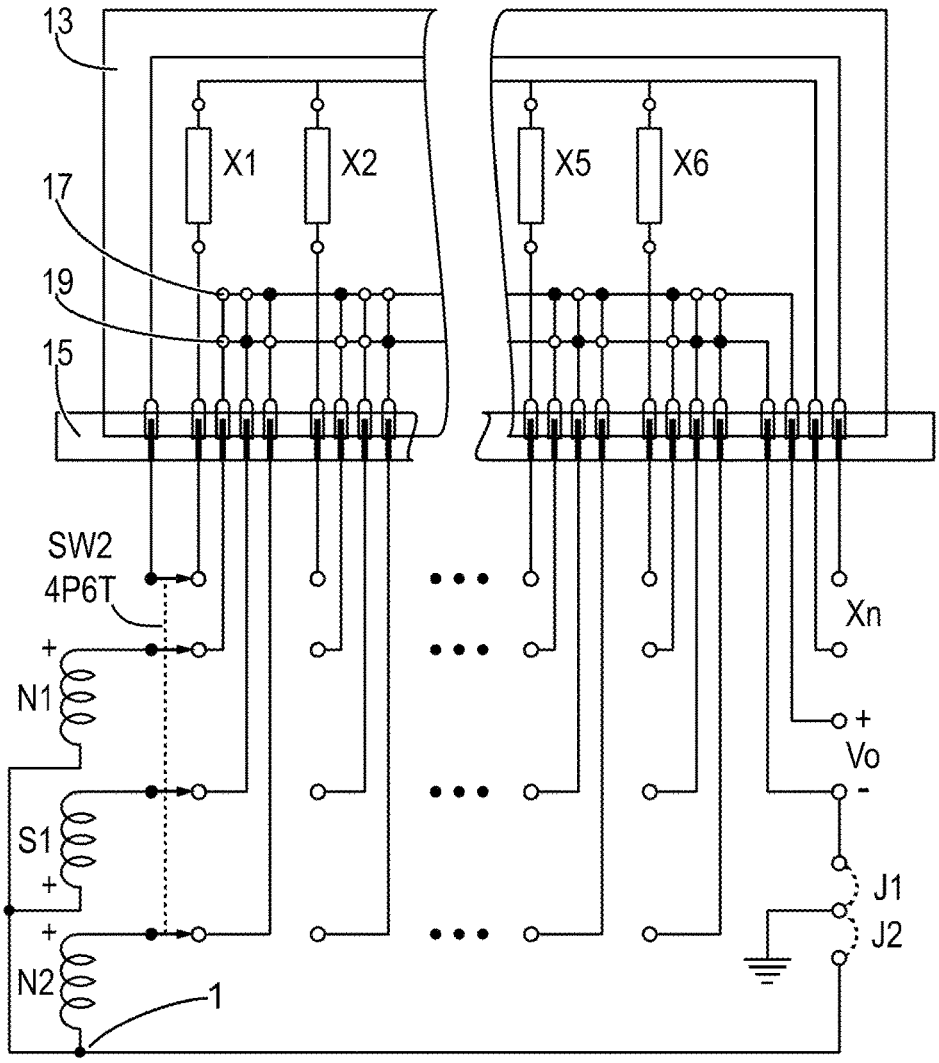
FIG. 8 shows the common connection point (1) switching circuit, like FIG. 7, with the on-switch wired interconnects on a 4P6T switch, SW2, replaced by a printed circuit board (13) and plug (15). The 6 throws for the 3 poles connected to matched pickups N1, S1 and N2, pass to the board with vertical wires on one side of the board and horizontal wires on the other side, connected by soldered through-board jumpers (black dots) to make connections to the high output terminal (17, Vo+) or the low output terminal (19, Vo−). The 6 throws for the $4^{th}$ pole connect to the board to switch adjustment components, X1 to X6, to the adjustment output (Xn). The jumpers (J1, J2) connect the system ground either to the common connection point (1) to make the output (Vo) differential, or to Vo− to make the output single-ended.

FIG. 8 shows such a device for this example. One S-up pickup, S1, and two N-up pickups, N1 and N2, have their common connection point (1) connected to jumper, J2, and their other terminals connected to the 4P6T switch, SW2. All of the switch throw interconnections are made off the switch, on a plug board (13), connected to the throws and one pole by a plug connector (15). The plug connector is shown as a fingerboard connector, but can be anything that fulfills the same function. The figure is split to show throws 1, 2, 5 and 6, but not 3 and 4. One pole and the six related throws of the switch connect to components X1 to X6 on the plug board, which can be any kind of printed circuit board, hard or flexible, or anything else that fulfills the function. Components X1 to X6 and the associated pole of SW2 are connected off the board to the output, Xn. These components can be resistors for gain control, or capacitors for tone control, or some other function.

The other three times 6 throws, connect through a line of cross-point interconnects (17) to the high output terminal, Vo+, and through another line of interconnects to the low output terminal, Vo−. The vertical circuit lines over the interconnects are on one side of the board and the horizontal lines on the other, so that they do not connect, except through the interconnects. The interconnects can be either non-plated-through holes for soldered through jumpers, or standard computer board jumpers, or some other type that fulfills the function. The white dots show no connection, and the black dots show interconnections. The interconnections shown produce output voltages of $Vo=V_{N2}+V_{S1}$, $Vo=V_{N1}-V_{N2}$, $Vo=(V_{N1}+V_{N2})/2+V_{S1}$, and $Vo=V_{N1}+(V_{S1}-V_{N2})/2$, for throws 1, 2, 5 and 6, respectively. Any combination and order of humbucking pairs and triples, including duplicates, is possible.

At the output, only one of jumpers J1 and J2 may be connected. If J1 is connected, then the lower terminal of Vo− is grounded, and the output is single-ended, as are most electric guitar circuits. If J2 is connected, then the common pickup connection point is grounded and the output, Vo, is differential. A differential output requires either that a differential amplifier convert it to single-ended, or that the output jack of the electric guitar is stereo, and feeds through 2-conductor shielded cable to a guitar amp with a differential input. A single-ended output has the advantage of using circuits and connections already common to electric guitars. A differential output has the advantage of suppressing common-mode electrical noise from external sources, possibly such as fluorescent lights, which put out much higher frequencies of noise than 60 Hz motors.

FIG. 8 can be adapted to any electro-mechanical pickup switching system. Baker, NP patent application Ser. No. 15/917,389, 2018 shows how there can be $2^{J-1}$ pole configurations for J number of matched single-coil pickups with reversible poles, or 4 pole configurations for 3 pickups, each having 6 possible pickup circuits, and 8 configurations for 4 pickups, each having 25 possible pickup circuits, and 16 configurations for 5 pickups, each having 90 possible pickup circuits. This switching system requires a pole for each pickup, and currently the most practical and affordable switches have six poles or less, and six throws or less. For example, with 3 pickups, a 4P6T switch can have one pole dedicated to a set of adjustment components, resistive or capacitive or something else, and a 5P6T switch can have two poles dedicated to adjustment components, say resistive for gain control with active circuits and capacitive for tone control.

Embodiment 2: Four Matched Coils with a 4P6T Switch

Figure 9:
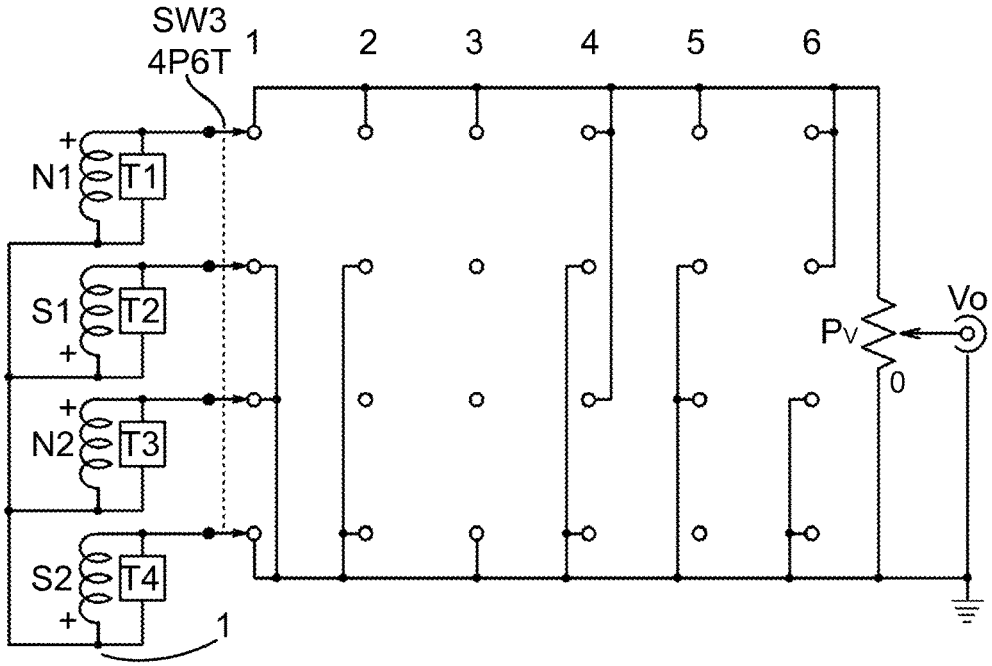
FIG. 9 shows two matched N-up pickups (N1 & N2) and two matched S-up pickups (S1 & S2) with attached individual tone circuits (T1 to T4) connected between an ungrounded common connection point (1) and the grounded volume control pot ($P_V$) to the single-ended output (Vo) through the 4P6T switch (SW3). In the order of throws, 1 to 6 respectively, the connections produce the circuits: N1+(S1+S2−N2)/3, N1+(S1+S2)/2, N1+S2, (N1+N2)/2+(S1+S2)/2, N1+(S1−N2)/2 and (N1−S1)/2+(S2−N2)/2, where the pickup designation also represent their vibration signals.

In this case, for a selection of poles from neck to bridge of N1, S1, N2 and S2, all 4 poles of the switch are taken by the terminals of the coils that are not connected at the common connection point (1). Compact 6P6T switches, capable of fitting neatly under a pick guard, are considerably less common, as well as much more expensive. FIG. 9 shows this circuit, wired from throw 1 to 6, respectively with the pickup circuits and the mean frequencies from Table 10: (1) N1+(S1+S2−N2)/3, 633.2 Hz; (2) N1+(S1+S2)/2, 669.8 Hz; (3) N1+S2, 713.5 Hz; (4) (N1+N2)/2+(S1+S2)/2, 741.5 Hz; (5) N1+(S1−N2)/2, 933.1 Hz; and (6) (N1−S1)/2+(S2−N2)/2, 1006.8 Hz.

Note that for the pair in throw 3, N1+S2, the lumped inductance of the circuit is 2*Lc, where Lc is the inductance of the coil of any matched pickup. For a humbucking triple, the lump inductance is 3*Lc/2, for a humbucking quad of 1-over-3, the inductance is 4*Lc/3, and for a humbucking quad of 2-over-2, the inductance is Lc. There are no poles left on the switch to make adjustments to the tone capacitor, so a tone circuit, T1, T2, T3 and T4 has been placed across each pickup. This might be comprised of a tone capacitor and a small multi-turn pot, accessible through a hole in the pick guard. Or it could be four separate capacitors connected to the switch end of each pickup, with a single 4-gang tone pot connected to each capacitor and the common connection point.

Note also that the plug board in FIG. 8 can also work here, but without the adjustment components, X1 to X6. If the pickups have reversible poles, a plug board would be advisable, since there can be 8 pole configurations and up to 25 switching circuits and 116 tones to choose from.

Embodiment 3: 3 Matched Pickups w/ Preamp & Signal Volume Compensation

Figure 10:
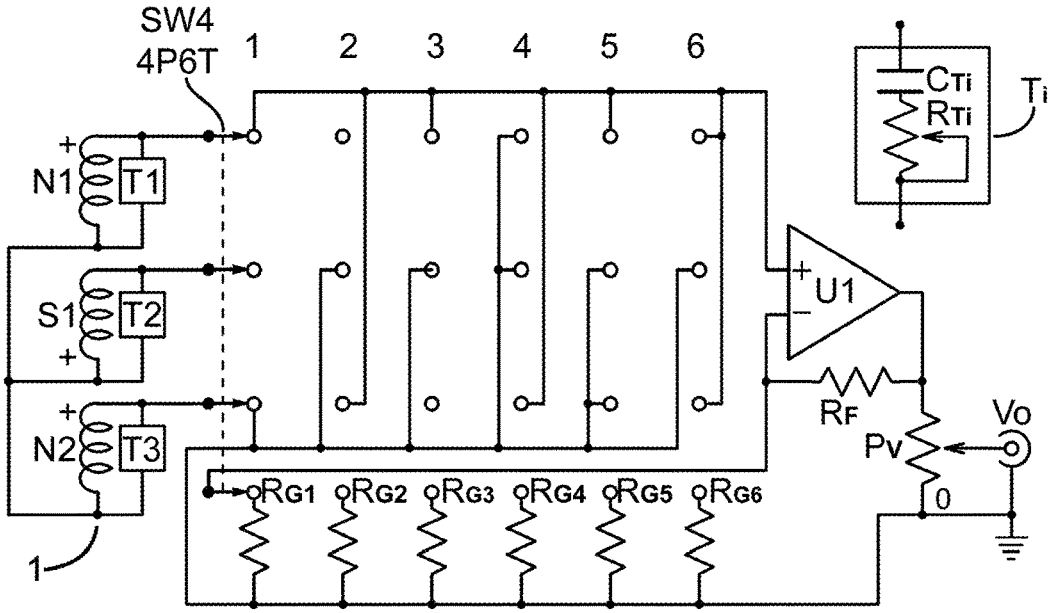
FIG. 10 shows a circuit similar to FIG. 7, with matched pickups N1, S1 and N2, having individual tone circuits, T1, T2 and T3, comprised each of a tone capacitor ($C_{Ti}$) and a tone pot ($R_{Ti}$), connected to a 4P6T switch (SW4) with three poles and their throws producing the same pickup circuit connections as in FIG. 7, and the fourth pole and throws connecting gain resistors (RG1 to RG6) to an output preamp (U1) with a feedback resistor ($R_F$). The single-ended output of the preamp circuit drives the circuit output (Vo) through a volume pot ($P_V$).

FIG. 10 shows this embodiment, with pickups N1 and N2 N-up, and S1 S-up. The 4P6T switch, SW4, uses 3 poles in a switching system with a common connection point (1) to connect the pickups by throws: (1) N1 over N2, or N1−N2; (2) N2 over S1, or S1+N2; (3) N1 over S1, or N1+S1, (4) N2 over N1&S1, or N2+(S1−N1)/2; (5) N1 over S1&N2, or N1+(S1−N2)/2; and (6) N1&N2 over S1, or (N1+N2)/2+S1, where the pickup designations also stand in for signal voltages. The circuit uses the $4^{th}$ pole to switch gain resistors, RG1 to RG6 into a circuit using operational amplifier U1 as a single-ended preamp with a feedback resistor, $R_F$. Math 9 shows the gains produced. The output of U1 feeds a volume pot, $P_V$, which goes to the output jack, Vo. The tone controls are T1, T2 and T3 across each pickup, each comprised of a tone pot, $R_{Ti}$, and tone capacitor, $C_{Ti}$. Note that the lower terminal of the switching system is grounded to the output, so the common connection point cannot be.

$$Gi = \frac{Vo}{Vs} = \frac{R_{Gi} + R_F}{R_{Gi}} = 1 + \frac{R_F}{R_{Gi}},\ R_{Gi} = \frac{R_F}{Gi - 1} \qquad \text{Math 9}$$

$$Gi\# = \frac{Vs\max}{Vsi},\ g = 1 + \frac{R_F}{R_{Gimax}},\ Gi = g * Gi\#$$

$$R_{Gi} = \frac{R_F}{Gi - 1}.$$

TABLE 11

Example gain resistors for Embodiment 3, FIG. 10, with $R_F$ = 47 k and $R_{G1}$ = 2.2M

| Throw | 1 | 2 | 3 | 4 | 5 | 6 |
|---|---|---|---|---|---|---|
| Relative Amplitude | 3.161 | 2.051 | 2.311 | 1.148 | 2.519 | 0.252 |
| Gi# = | 1 | 1.54 | 1.37 | 2.75 | 1.25 | 12.54 |
| Gi = g*Gi# = | 1.021 | 1.57 | 1.40 | 2.81 | 1.28 | 12.81 |
| $R_{Gi}$(kΩ) | 2200 | 82 | 128 | 26 | 170 | 4 |

Since we have no experimental data for a 3-coil guitar, let the relative signal amplitudes before amplification in Table 11 stand in for the sake of argument and example. We conveniently choose the maximum relative signal strength of 3.161 as the first gain, and we wish to adjust the other gains to bring all the other signals up to that level at the output, Vo. Dividing that relative amplitude by all the others, give the relative gain, Gi#, for each signal that we need to approach. But if we pick a feedback resistor, $R_F$=47 k, and a minimum gain resistor $R_{G1}$=2200 k, or 2.2M, then the first gain will be 1.024 instead of 1. We have to multiply this number times all the gains to get the real gains, then calculate $R_{Gi}$. Math 9 and Table 11 show these calculations.

Only a few of the $R_{Gi}$ values are close to standard resistor values. Given that and the differences between human perception and electronic measurements, it would be better to use small, square multi-turn potentiometers for the other $R_{Gi}$. And if any of the pickup poles are to be reversed, it would be better to use a connection plug board, like that in FIG. 8, with the pots mounted in place of the components, Xi.

Embodiment 4: 3 Matched Coils w/4P6T Switch & Differential Preamp

Figure 11:
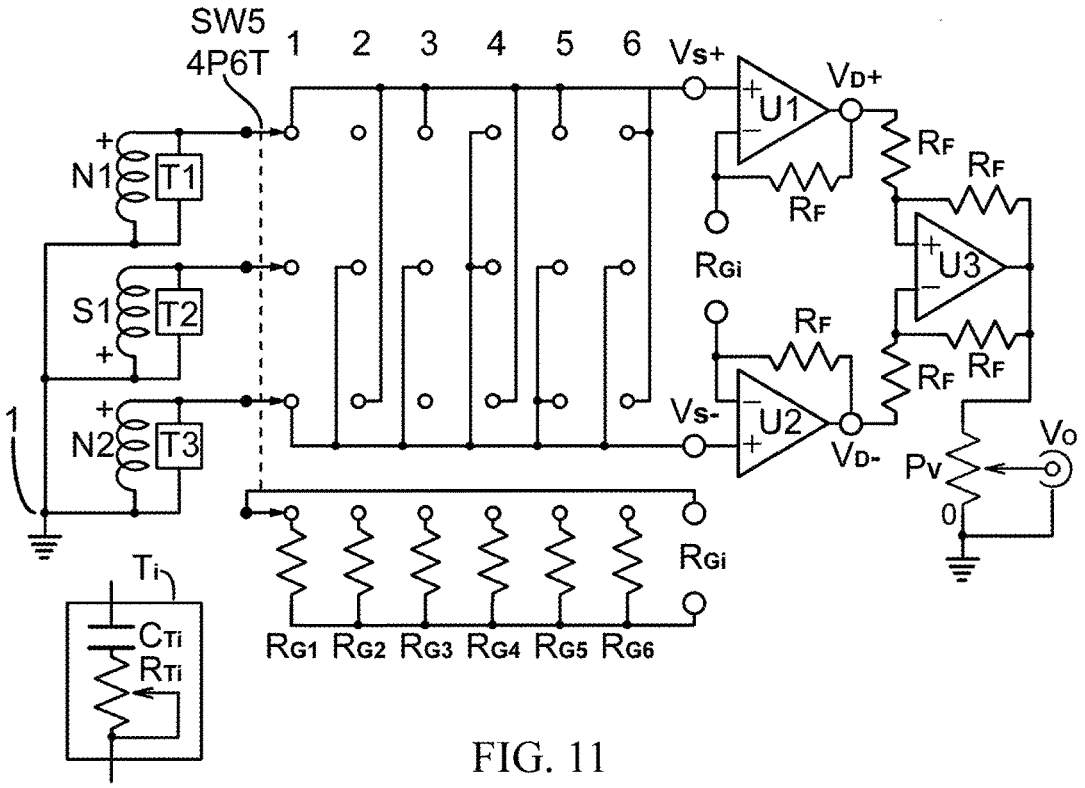
FIG. 11 shows a similar circuit to FIG. 10, but with the common connection point (1) grounded, and the switch (SW5) output ($V_{S+}$, $V_{S-}$) connected to a differential input, single-ended output amplifier comprised of the differential input section (U1, U2, $R_F$, $R_F$, $R_{Gi}$) and the single-ended output section (U3, $R_F$, $R_F$, $R_F$, $R_F$), feeding through a volume pot ($P_V$) to the single-ended output (Vo).

FIG. 11 show this embodiment. It differs from FIG. 10 by grounding the common connection point (1) of the pickups, N1, S1 and N2, and by having a preamp with a differential input and a single-ended output. A differential amplifier has the advantage of removing pickup signal common-mode voltages at the preamp input, Vs+ and Vs−, from the output, Vo. So if the pickups see an external. interference signal that raises all of their voltages at the SW5 switch poles above ground, it essentially disappears at Vo, reduced by up to 100 decibels. The gain calculations are also different, as shown in Math 10, being about twice as large as a single-ended amplifier for the same values of $R_F$ and $R_G$. Again, if one intends to reverse any pickup poles, the plug board from FIG. 8 should be added to the circuit, and the components X1 to X6 replaced with $R_{G1}$ to $R_{G6}$, preferably small, multi-turn pots.

$$Gi = \frac{Vo}{Vs} = \frac{R_{Gi} + 2 * R_F}{R_{Gi}} = 1 + \frac{2 * R_F}{R_{Gi}}, \qquad \text{Math 10}$$

$$R_{Gi} = \frac{2 * R_F}{Gi - 1}$$

$$Gi\# = \frac{Vs\max}{Vsi},\ g = 1 + \frac{2 * R_F}{R_{Gimax}},\ Gi = g * Gi\#$$

$$R_{Gi} = \frac{2 * R_F}{Gi - 1}.$$

Embodiment 5: 3 Humbuckers with 6PXT Switch

Figure 12:
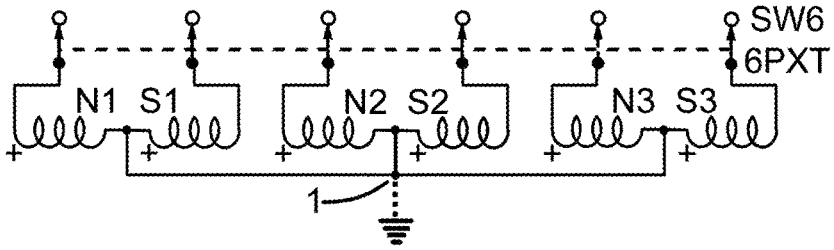
FIG. 12 shows three matched dual-coil humbucking pickups (N1S1, N2S2, N3S3), with their center tap connected to the common connection point (1), which is either grounded or not, depending on whether the output of the 6-pole X-throw switch (SW6) is intended to be single-ended (not grounded) or differential (grounded). Only the first poles are shown.

FIG. 12 shows this embodiment, simply as the humbuckers and the poles of a 6-pole, multi-throw switch, merely to show how the common connection point (1) works with dual-coil humbucking pickups. The center taps, between the N-up and S-up, coils are all connected together, and grounded according to Rule 3, depending on whether the output terminals of the switch, SW6, are to be single-ended (ungrounded) or differential (grounded). Since there are a possible 301 combinations of humbucking pairs, triples, quad, quints and hexes for the 6 coils of 3 humbuckers, and a $50.00 6P6T switch is at the upper end of capability for available mechanical switches, this illustrates the need for something better, namely digitally-controlled analog switching.

Embodiment 6: 2 Humbuckers w/6P6T Switch and Differential Preamp

Figure 13:
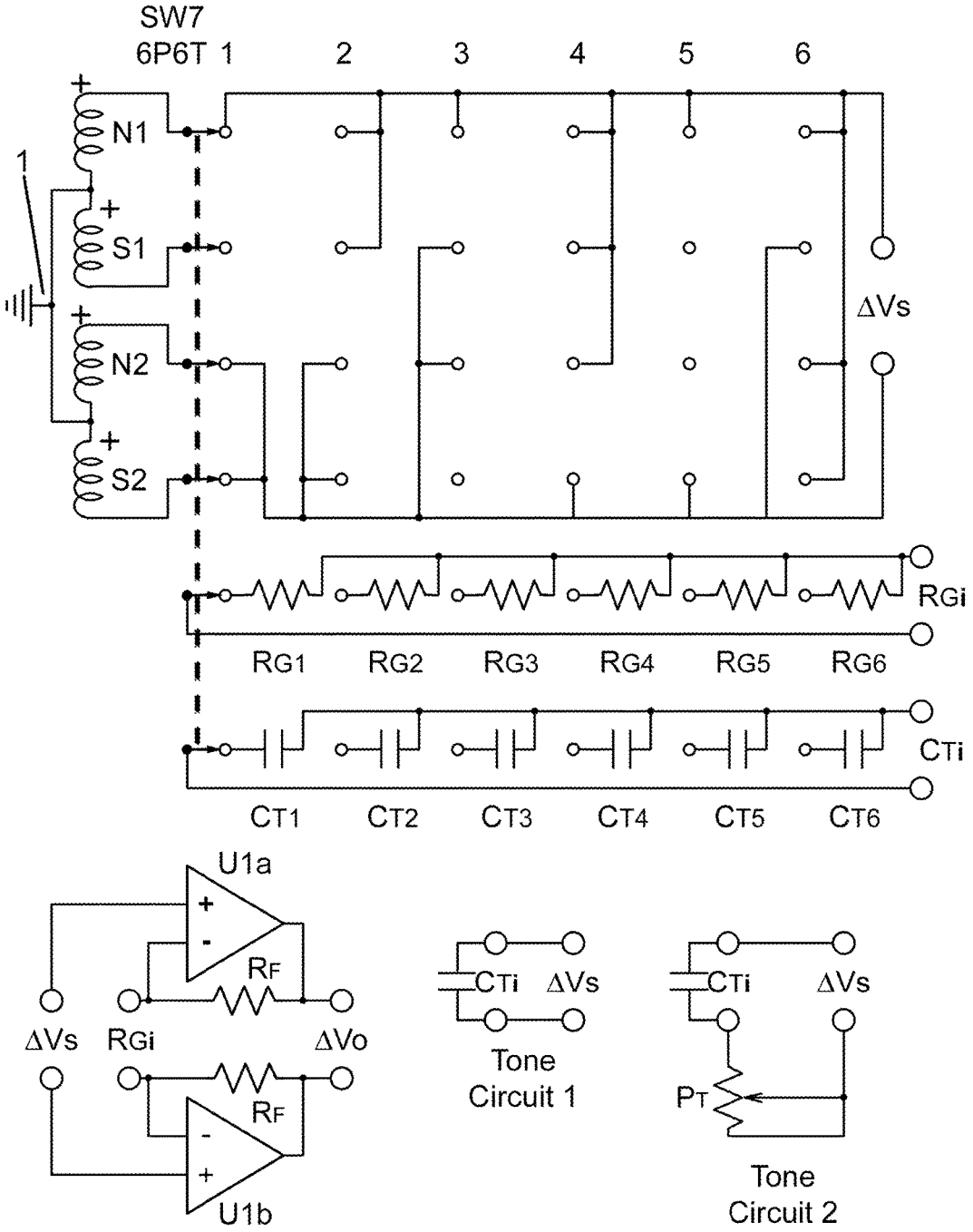
FIG. 13 shows two humbucking pickups (N1S1, N2S2) with center taps connected to a grounded common connection point (1), and through the connections of a 6P6T switch (SW6) to the differential switch output ($\Delta V_S$), which is connected to a differential amplifier, comprised of operational amplifiers sections U1*a* and U1*b*, two feedback resistors ($R_F$,$R_F$) and a gain resistor ($R_{Gi}$), which is switched by SW6 among gain resistors $R_{G1}$ to $R_{G6}$. One pole and the related throws of SW6 connect tone capacitors $C_{T1}$ to $C_{T6}$ to either Tone Circuit 1 (a resonant capacitor, $C_{Ti}$) or Tone Circuit 2 (a tone capacitor, $C_{Ti}$, and a tone pot, $P_T$), which is situated at the output of the switch, $\Delta V_S$. The output of the differential amplifier is ΔVo.

FIG. 13 shows 2 humbuckers connected to 4 poles of a 6P6T switch, SW7, using 6 of the circuit configurations of Table 10 as an example, as shown in Table 12, going from the bright tone on throw 1 to the warm tone on throw 6. The connections have been inverted from Table 10 in throws 4 & 6 to keep most of the signal signs positive. The inductance of a single coil is $L_C$. Note that the center taps of the humbuckers are connected to a grounded common connection point (1), as in FIG. 12.

TABLE 12

| Order of tone mean frequencies from 1201 Hz to 633 Hz for a 6P6T switch | | | |
|---|---|---|---|
| Throw | Pickup circuit signal | Mean freq (Hz) | Lumped circuit inductance |
| 1 | N1 + (S2 − N2)/2 | 1201.1 | $3*L_c/2$ |
| 2 | (N1 − S1)/2 + (S2 − N2)/2 | 1006.8 | $L_c$ |
| 3 | N1 + (S1 − N2)/2 | 933.1 | $3*L_c/2$ |
| 4 | (N1 + N2 − S1)/3 + S2 | 827.6 | $4*L_c/3$ |
| 5 | N1 + S2 | 713.5 | $L_c$ |
| 6 | (N1 + N2 − S2)/3 + S1 | 632.9 | $4*L_c/3$ |

Since only 4 poles of the 6 pole switch are needed to switch the pickup terminals to the switch output, ΔVs, the other 2 are available to switch the gain resistors, $R_G$i, and the tone capacitors, $C_T$i. The gain resistors are again calculated according to the principles of Math 10 and Table 11, according to the measured relative signal amplitudes of ΔVs for all 6 throws. Since the resonant or low-pass frequency of an inductor and capacitor goes according to the product of LC, Math 11 shows the relationships between the values of $C_T$i, for which only 3 actual capacitors are needed, since there are only 3 lumped values of switched circuit inductance.

$$2\pi f = \frac{1}{\sqrt{LC}} \Rightarrow Ca*Lc = Cb*\frac{3*Lc}{2} = Cc*\frac{4*Lc}{3} \qquad \text{Math 11}$$

$$Ca = C_{T2} = C_{T5},\ Cb = \frac{2}{3}Ca = C_{T1} = C_{T3},$$

$$Cc = \frac{3}{4}Ca = C_{T4} = C_{T6}.$$

The tone circuit can be any useful form, such as Tone Circuit 1 or Tone Circuit 2. The switch output, ΔVs, feeds into the differential amplifier comprised of U1*a*, U1*b*, 2 feedback resistors, $R_F$, and the switched gain resistor, $R_G$i, has a differential output, ΔVo. Considering that the four coils can be connected into 25 different circuits with this switching system, and with 116 potentially unique tones, using the plug board of FIG. 8 would make the system more versatile. Using the bottom two poles and throws in FIG. 13, the plug board components, X1 to X6, could be replaced by small pots for the $R_{Gi}$, and doubled, adding a capacitor, $C_{Ti}$, and small pot, $P_{Ti}$, each comprising Tone Circuit 2 in the second set of components X7 to X12.

Embodiments of Analog-Digital Switching Systems

The possibility results of Tables 4, 6, 7 and 10, of so many more configurations and tones than electro-mechanical switches can control, justify the use of digitally-controlled analog switches. Micro-power micro-controllers (uC) offer display, user interfaces, control and longer battery life, but few if any have the arithmetic processing units with the necessary trigonometric functions to calculate Fast Fourier transforms, which might be used to order tones. It will likely be necessary to add math processing units (MPUs). With such capability, and not yet fully determined algorithm for determining timbre and tone from strummed strings, it should be possible to offer the musician a user interface with a simple one-switch to one-swipe control to shift progressively from bright to warm tones and back without the musician ever needed to know which pickups are used in what configurations. In this disclosure, the mean frequency of six strummed strings is used as an example of the order of tone, which will likely be superseded by other measures. Nevertheless, the system architecture that will allow such measures and control will remain relatively constant for a while.

Embodiment 7: J=K Coils w/ Digital Control of SMD Analog Switches

Suppose that we have J number of N-up pickup coils and K number of S-up pickup coils, and we have chosen to use the common connection point switching system, where one terminal of each coil, regardless of magnetic pole direction (or electric pole for other sensors), are connected to a single point according to the same phase of external hum. In this switching system, there are 3 choices, or 3 states, for the other terminals of each coil to be connected by the switching circuit: 1) connected to the low output terminal of the switching system; 2) connected to the high output terminal of the switching system; or 3) not connected to either terminal. There is also the choice of how the ground is connected in the switching system, according to Rule 3. It is connected either to the low output terminal, or to the pickup common connection point. It is also possible to break the Rule, and ground both the common pickup connection and the low output terminal, so as to isolate the output of just one coil connected to the high output, for tuning and measurement purposes.

Figure 14A:
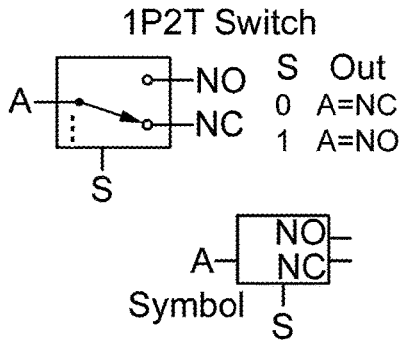
FIGS. 14A-B show symbolic functional (above) and circuit block (below) diagrams for digitally-controlled analog solid-state switches with 1P2T (14A) and 1P3T (14B), along with the logic state diagrams (S Out, 14A; S1 S0 Out, 14B) for those switches, respectively. In all cases, A is the input and S, S0 and S1 are the digital level control signals. NO means normally open and NC means normally closed.
Figure 14B:
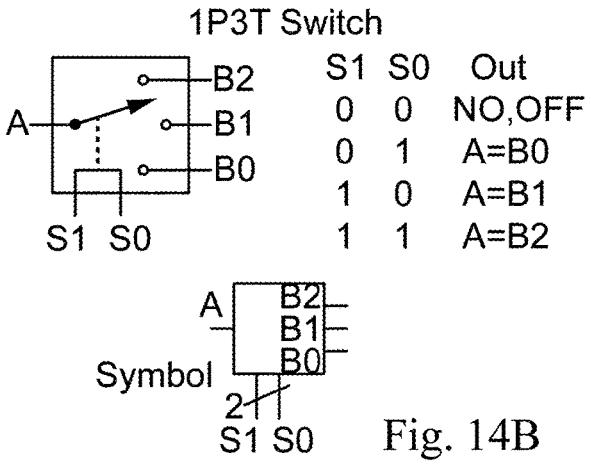

For this we need digitally-controlled solid-state analog signal switches to reach the full potential of a switching system with more than 3 or 4 coils. FIG. 14 shows two such switches, a single-pole double-throw switch (FIG. 14A), and a single-pole triple throw switch (FIG. 14B), with the additional state of no connection at all. The 1P2T switch in FIG. 14B has a normally closed (NC) connection to the single pole, A, when the digital control, S, is at a low or binary "0" state. When S=1, A is connected to the normally open connection, NO. The 1P2T switch can be used to connect the system analog ground to either the low output terminal or to connect the low output terminal to the pickup common connection, depending upon whether the amplifier at the switching system output is single-ended or differential. Or it can be used to switch tone capacitors.

The 1P3T switch in FIG. 14B, has one pole, A, which is connected as shown in the table for the digital inputs, (S1, S0), to B0, B1, B2 or nothing, an open circuit, NO. When the digital state of (S1,S0)=(0,0), the A terminal is connected to nothing, like an open circuit. When (S1,S0)=(0,1), A is connected to B0, which can be the low output terminal. When it is (S1,S0)=(1,0), A is connected to B1, which can be the high output terminal. When (S1,S0)=(1,1), A is connected to B2, which can be the pickup common connection, this shorting out the coil. The best use of either (S1,S0)=(0,0) or (1,1) remains to be determined, according to the best performance of the circuit, but should have very similar results.

While it is possible to use a digitally controlled analog cross-point switch, they can come as large DIP chips, with more than a score of pins, or require supply voltages in excess of 5V, or have contact resistances of tens of ohms. A cross-point switch typically addresses only one contact at a time, requiring addressing and data strobing for each separate connection. For a 6×8 cross-point switch (should one exist), used with four coils, a set of gain resistors and a set of tone capacitors, there are 6*8=48 different cross-connections that have to be set individually by addressing.

The switches in FIG. 14 have only 1 or 2 bits of digital control, which can be the output lines of a micro-controller. In some cases, it may be advisable to add latches, if those uC lines are also used for other functions. The switches are small surface mount devices, often costing less than a dollar (US) each, with contact resistances down to about 1 ohm.

With 4 coils, there are as may as 25 possible circuits requiring as many as 25 gain resistors to equalize the signal voltages. Or, alternatively and more efficiently, since a micro-controller is now available, digital pots can be used to set gain. FIG. 15 shows a single-ended amplifier (15A) and a differential amplifier (15B), with feedback digital pots PF, $P_{Fa}$ and $P_{Fb}$, op-amps U1, U2*a* and U2*b*, and 2 gain resistors, $R_G$. The digital feedback pots can be 100 k with 256 equal steps. Math 12a&b show the equations for the pots and circuit gain. The dotted line between $P_{Fa}$ and $P_{Fb}$ indicates that they must be set to the same wiper positions in tandem to keep the output balanced about signal ground. Some digital pots come 2 to a chip. The output of the differential amp can be either differential, as shown, for use in further signal conditioning, or use the single-ended output structure of U3, $R_F$ and $P_V$ in FIG. 11.

$$\text{Resistance from "0" to } P_F \text{ wiper} = \frac{n * P_F}{256} \qquad \text{Math 12a}$$

$$\text{Resistance from } P_F \text{ wiper to other pot end} = \frac{(256 - n) * P_F}{256}$$

$$\text{Single-ended gain} = \frac{V_O}{V_S} = G = \frac{R_G + P_F}{R_G + P_F * \frac{256 - n}{256}} \qquad \text{Math 12b}$$

$$\text{Differential gain} = \frac{V_O}{V_S} = G = \frac{R_G + 2 * P_F}{R_G + 2 * P_F * \frac{256 - n}{256}}.$$

Figure 15A:
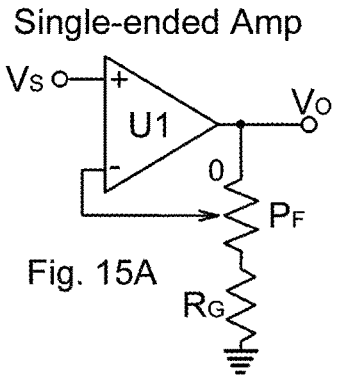
FIGS. 15A-B show circuits for single-ended (15A) and differential (15B) amplifiers, with inputs Vs and outputs Vo, using operational amplifiers (U1, U2*ab*), a gain resistors ($R_G$) and feedback pots ($P_F$, $P_{Fab}$), especially digitally-controlled pots.
Figure 15B:
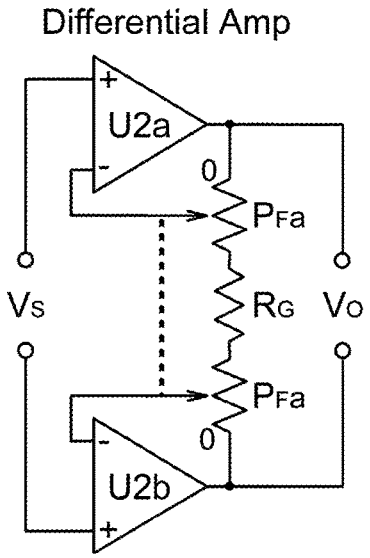
Figure 16A:
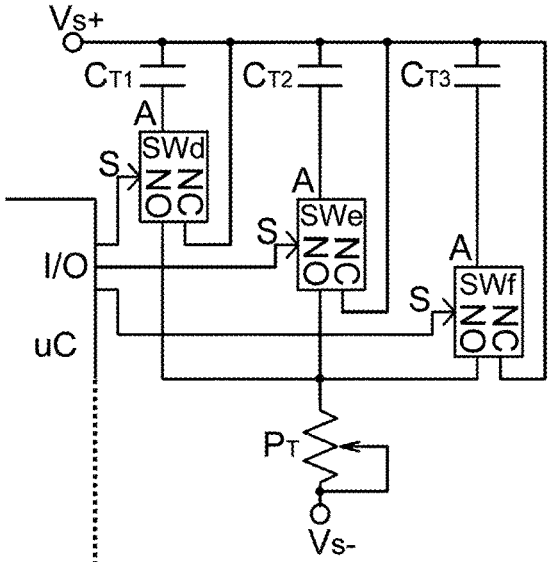
FIGS. 16A-B show two versions of digitally-controlled switched tone controls, using the solid-state switches from FIGS. 14A-B.
Figure 16B:
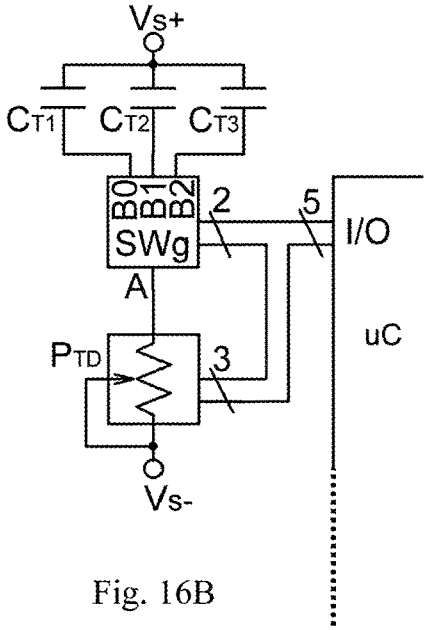

Calculations elsewhere, using the resistance granularity of digital pots, indicate that using digital pots to set gain in FIG. 15*a*, with 256 equal resistance steps, $P_F$=100 k and $R_G$=5.1 k, can equalize the relative amplitudes in Tables 9 & 10 within a range of ±5%, over a gain range of G=1.0 to 20.6. Digital pots typically have a serial interface comprised of 3 lines. For 4 coils, there are only 3 different lumped circuit inductances. So only 3 tone capacitors are needed to compensate for those differences, possible with 3 of the 1P2T switches, requiring 3 lines of digital control, or 1 of the 1P3T switches, using 2 lines of digital control. FIG. 16 shows these alternatives, the 1P2T switches in FIG. 16A, and the single 1P3T switch in FIG. 16B, driven directly by the digital I/O lines of a micro-controller. In FIG. 16A, the tone pot, $P_T$, is manual, and in FIG. 16B, it is digital, $P_{TD}$, with 3 control lines going to the uC I/O. Either pot could be used in either side, depending on the overall circuit design. The circuit in 16A can produce 7 possible tone capacitances, or none, by connecting 0, 1, 2 or 3 in parallel. The circuit in 16B can produce only 3. Table 13 shows the number of uC input/output lines needed for 4 coils, according to the circuits in FIGS. 14-17. It may be advisable to use addressing and latches if some of these lines are to be used for other functions, such as User Controls and Displays.

TABLE 13

Figure 17:
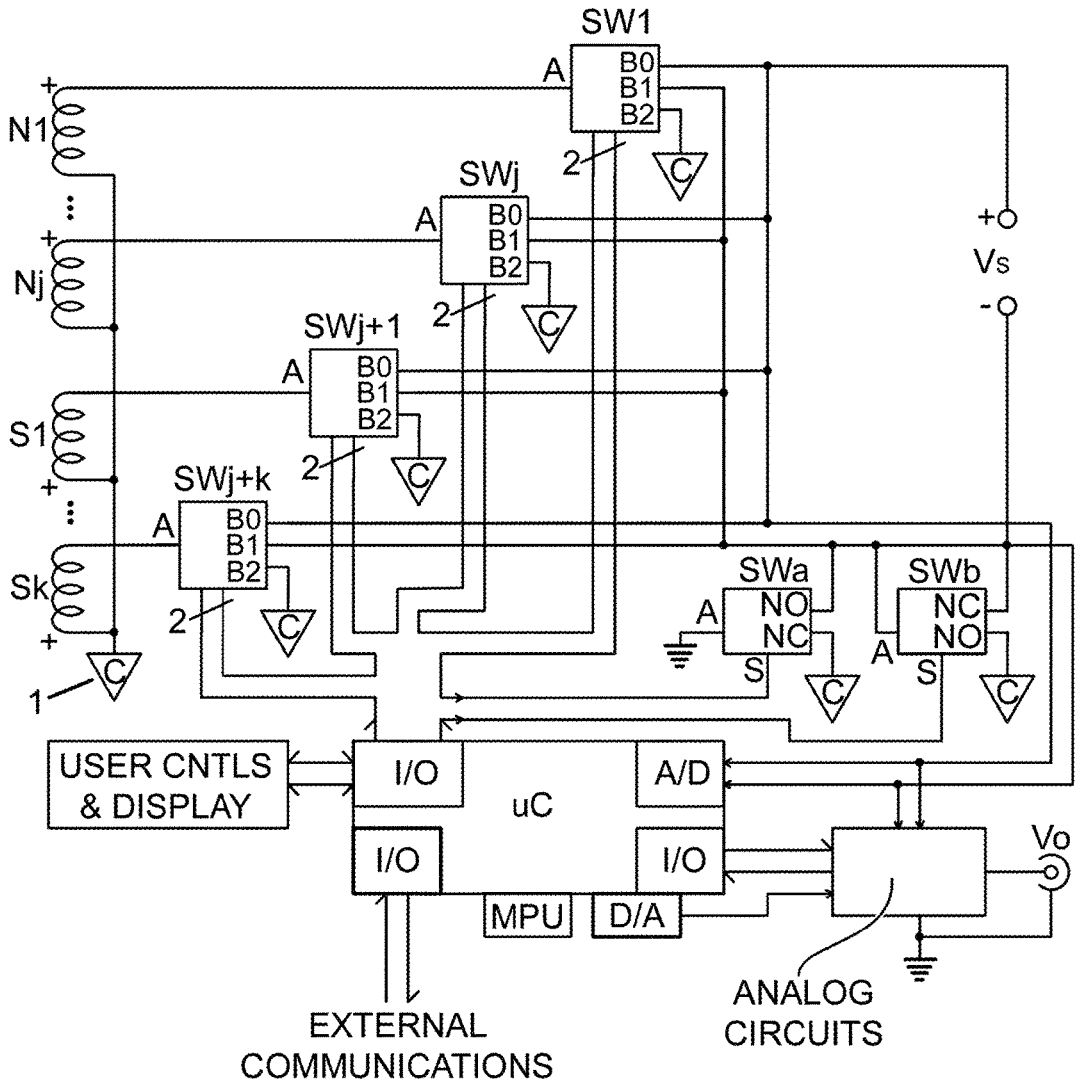
FIG. 17 shows a micro-controller (uC) driving a common connection point (1, C in a triangle) solid-state switching system, with 1P3T switches SW1 to SWj, for N-up matched pickups, N1 to Nj, and 1P3T switches SWj+1 to SWj+k for S-up matched pickups S1 to Sk. The switch outputs are Vs+ and Vs−, which can be differential or single-ended according to the digitally controlled 1P2T ground switch, SWa. The 1P2T switch, SWb, shorts out the lower output pickup coils to the common point (1), to allow for the measurement of single or multiple parallel pickups. The output of the switching system passes through an ANALOG CIRCUITS section, made up of parts of previous figures, with uC controls for gain adjustment, to the single-ended output, Vo. The uC has I/O controls for USER CONTROLS & DISPLAY for the use interface, an analog-to-digital converter (A/D), a math processing unit (MPU), which can be an external co-processor, necessary for taking A/D signal samples to produce FFT spectra to use in ordering tones. A digital-to-analog (D/A) section feeds inverse-FFT audio signals into the Analog Circuits section for output to help the user recall the tones for individual pickup circuits. One section of I/O handles EXTERNAL COMMUNICATIONS, by which the uC can be tested and reprogrammed, and engage in other useful functions, such as allowing the user to use other keyboard and computer devices to control it and the switching circuit.

Numbers of uC I/O lines needed for 4 coils in FIG. 17

| | | | min | max |
|---|---|---|---|---|
| 4 coils | 4 1P3T | 4 1P3T | 8 | 8 |
| 3 tone caps | 1 1P3T | 3 1P2T | 2 | 3 |

TABLE 13-continued

Numbers of uC I/O lines needed for 4 coils in FIG. 17

| | | | min | max |
|---|---|---|---|---|
| Tone pot | manual | digital | 0 | 3 |
| Single-ended or diff amp | 1 dig pot | 2 dig pots | 3 | 6 |
| Volume pot | manual | digital | 0 | 3 |
| Total | | | 13 | 23 |

FIG. 17 shows a micro-controller architecture for switching the combinations of J number of N-up coils, N1 to Nj, with their negative phase terminals connected to the common connection point (1), also denoted by a "C" in a triangle, and K number of S-up coils, S1 to Sk, to the switching system output, Vs, and then on to the analog signal conditioning circuits and the guitar output, Vo. The intermediate coils are not shown. The User Cntls & Display and MPU sections are explained below, and the Analog Circuits section is made up of circuits from FIGS. 10, 11, 15 and/or 16.

The outputs of the coils are switched by the respective 1P3T digital-analog switches, SW1 to SWj, and SWj+1 to SWj+k. The intermediate switches are not shown. The 1P3T switches, as in FIG. 14B, have a four-state output, leaving the A terminal normally open, or connected to the B0 terminal, or the B1 terminal, or the B2 terminals, which are shown reversed vertically from FIG. 14B, to simplify the circuit. All the B0 switch terminals go to the high switch output terminal, Vs+; all of the B1 switch terminals go to the low switch output terminal, Vs−; and all of the B2 switch terminals go to the pickup common terminal, triangle-C. So for each of the (S1,S0) states, (S1,S0)=(0,0) disconnects the coil from any other part of the circuit; (S1,S0)=(0,1) connects the coil to Vs+; (S1,S0)=(1,0) connects the coil to Vs−; and; (S1,S0)=(1,1) connects the coil to the common terminal, shorting it out. Whether shorting the coil out has any effect on the tonal outputs remains to be determined.

The two 1P2T switches, SWa and SWb, perform other functions. For S=0, SWa connects the ground to the pickup common connections, making the switching output, Vs+, suitable for connection to a differential amplifier in the Analog Circuits section (FIGS. 10, 11, 13, 15&16, with FIG. 10 $P_V$ output for FIG. 15A and FIG. 11 output for FIG. 15B). For S=1, SWa connects the ground to Vs−, making Vs suitable for connection to a single-ended amplifier in the Analog Circuits section. Since the Analog Circuits section is not likely to be switchable between single-ended or differential amplifiers, SWa could be replaced by a set of jumpers performing the same function.

For S=0 (a separate control line from SWa), SWb shorts itself out and has no function, but for S=1, it connects Vs− to the pickup common connection point (1), allowing the output of a single pickup coil, or a set of parallel pickup coils, connected to Vs+ to be fed to the Analog Circuits section. This will be useful for measuring or tuning single coils. The Analog Circuits section is taken to contain all the analog signal circuits. FIG. 17 shows sensor and control lines between it and the micro-controller, uC, to handle such functions as the switching of tone capacitors.

The micro-controller, uC, is shown with two-way digital connections to the User Controls and Display (adequately defined in NP patent application Ser. No. 15/616,396); one-way control connections to 1P3T switches SW1 to SWj+k; one-way control connections to SWa and SWb; one-way connections from the switching system output, Vs, to an internal analog-to-digital converter (A/D); two-way sense and control connections with the Analog Circuits section, and a Math Processor Unit (MPU). The MPU section can be either internal to the uC, if available, or an add-on co-processor. Either way must be capable of at least 32-bit floating point operations on complex variables, having sufficient trig and other math functions to accomplish Fast Fourier Transforms (FFTs).

Using start-stop signals from the Analog Section or the User Controls and Display, the FFT section performs complex FFTs on such inputs as the six strummed strings, as described in "An experiment with 2 mini-humbuckers". The FFT section takes A/D information from the audio signal, Vs, to generate the complex FFTs needed for Math 8. The complex FFTs generated should have a resolution of at least 1 Hz, and a frequency range of at least 0 to 4 kHz, preferably to 10 kHz, and adjustable in bandwidth. It will be necessary to switch the pickups during the A/D signal collection to obtain nearly simultaneous sequential measurements either of all the coils separately, and/or all the coils in humbucking pairs, corrected for time delays according to Math 13, to produce effectively simultaneous complex FFT spectra for the calculations in Math 8.

$$x(t-t_0) \Leftrightarrow X(f)*e^{-j2\pi f t_0}, e^{-j2\pi f t_0} = \cos(2\pi f t_0) - j\sin(2\pi t_0) \qquad \text{Math 13.}$$

A digital-to-analog converter (D/A), which can be either internal in the uC, or an external circuit, feeds the audio from inverse-FFT transformations of measured signal spectra into the Analog Circuits section to help the user recall pickup circuit tones and to make better decisions on any user-defined tone switching sequences. From this information, the switched coil combinations can be ordered by mean output frequency from bright to warm or warm to bright, as a first approximation of the order of tones. Or set by user preference. The tones in signal output from the switching system can be equalized in volume, according to Math 12ab, and Math 9 or Math 11, in the Analog Circuits section by variable gains set by the uC. Then the user can use the User Controls and Display to shift monotonically from tone to tone without having to specify the particular switched coil combination that produces it.

Embodiment 8: Digital Switching without a Micro-Controller

If for some reason a uC will not be used, the switching circuit in FIG. 17 can be controlled by a simple up-down switch and an up-down digital ripple counter using the same number of ripple outputs as the number of desired circuits to be switched. The same 1P3T solid-state switches can be used. Gain resistors and tone capacitors can be switched from the same ripple counter control signals. Another up-down switch and ripple counter can be used for switching tone capacitors, if desired. Here again, the plug board from FIG. 8 can be useful, especially if more than 3 pickups or reversible-pole pickups are used. It can also be adapted to many more than just 6 switched selections.

The single bit of each ripple output can be connected to multiple switch control lines (S, S0 and S1 in FIG. 17), with each connection set isolated from every other by something as simple as diode or transistor isolators. Some digital signal inverters will likely be necessary. In diode isolators, two or more diodes can be connected with all the anodes, or all the cathodes connected to the control line output from the ripple counter, and the other terminal to each of the relevant switch controls. The direction of the diode polarities depends only on whether the switch control lines have either pull-up resistors to be pulled down by the ripple output, or pull-down resistors to be pulled up. Schottky with a low forward voltage drops will work best. It's an old technique dating back to the diode-transistor logic (DTL) of the 1960s that still works. It's so old and simple that a Figure is not necessary to illustrate it.

Method of Choosing the Spacing and Switching Order of Tones

The object of the exercise is to offer a much wider range of tones, and to allow the musician to use one control to shift progressively from bright to warm and back, without ever needing to know which pickups are used in what circuit. For that, one needs a way to order the tones.

There is no guarantee at this time that using the mean frequency of the signal from one or more strummed strings, with either open fretting or some chord, will correspond exactly to brightness or warmness of tone, as commonly perceived by a musician's ears. For example, R. M. French (2009, Engineering the Guitar, Theory and Practice, Springer, N.Y.) noted in a section on psychoacoustics, pp 190-193, that louder tones mask nearby tones. And on pp 29-36, in a section on human perception of sound, he notes that the sensitivity of human hearing to tones peaks at 1000 to 2000 Hz. This method of ordering tones needs a simple one-number measure of tone that has not yet been developed and proven. But the mean frequency of six strummed strings is a start, used here as an example until better methods come along.

The mean-frequency numbers used here for illustrating the method come from Math 8 and Table 10, from the dual-humbucker experiment previously disclosed, which also helps to illustrate the method. Ideally, the frequency resolution should be 1 Hz, with a range of from 0 Hz to a top end of at least 4 kHz, but preferably the full range of human hearing, which extends to 20 kHz or more. Preferably, enough sample windows should be taken to cover from the very beginning of a strummed or plucked note or chord through the full sustain of the sound. But it may turn out that other sampling techniques have certain advantages not discussed here.

One should expect that, like the dual-humbucker experiment, some tones will be too close together to count, and the separation of tones with switched pickups circuits will vary considerably, likely with most of the tones bunched together at the warm end. So, for four pickups with 25 different circuits, there may be only half that number of useful tones. And for 25 different circuits and a six throw switch, only half of those can be used. For pickups with reversible poles, four pickups have 8 different pole configurations, sharing 25-member sets of 116 potentially unique tones. (The ratio of the numbers poles times circuits to the numbers of tones is always greater than or equal to one.)

Digitally-controlled analog switching may have a much wider range of choice than mechanical switches, but the problem of bunched tones still exists. Note that in Table 10, the range of mean frequency from 632.9 Hz at the low end to 1201.1 Hz at the high end, for one pole configuration, is barely an octave. Without actual measurements, it is not yet possible to know what other pole configurations will produce. Nor is it yet possible to account for the variations introduced by moving pickups themselves about in space, as disclosed in U.S. Pat. No. 9,401,134B2 (Baker, 2016), offering 5 degrees of freedom, vertically and along the strings at each end of a pickup, as well as across the strings.

This method assumes that whatever the measure of tone, it should be divided along bright to warm, or warm to bright, according to virtual frets. In most Western music, adjacent notes differ by a multiplier or divisor of $2^{1/12}$, counting 0 to 12 frets from an open note to its octave note. Other musical traditions can have three times as many notes in an octave. This division of frequencies comes from the way that the human ear is constructed and responds to sound. So it is natural to assume that the most effective and efficient way to chose the separation of tones chosen and ordered from those available is by a constant frequency multiplier from one tone to the next higher tone.

The method disclosed here is fairly simple: (1) chose a measure of tone (mean frequency of six strummed strings from FFT analysis in these examples); (2) cause the musical instrument to emit tones in some standard fashion (strum six strings several times in these examples); (3a) take digital acoustic samples of the signal outputs from each pickup simultaneously (not quite possible in these examples), or alternatively, (3b) take digital acoustic samples from each switched pickup circuit; (4) digitally process the acoustic samples to obtain complex number frequency spectra for each pickup or each pickup circuit (only magnitudes of frequency bins were possible for these examples, leaving out phase information); (5) apply the measure of tone to the individual frequency spectra (Math 8 and Table 10 in these examples); (6) pick the range of tones (from mean frequencies in Table 10 in these examples); (7) pick the number of tones to be switched (for example, six tones for a 6 throw switch); (8) calculate the virtual fret steps between switched tones; (9) choose the closest available tones to those steps; and (10) wire or program the mechanical and digital-analog switch to select the circuits that produce those tones.

Since human hearing is very subjective, there's an alternative extension to the method that orders the tones according to the musician's preference. Anytime after step 4, when the samples have been taken and FFT transforms have been stored, the inverse-FFT transform can convert the spectra back into a string of sounds. The sound that comes out will be the average of all the sample windows taken over the entire original length of the notes. So the strike and decay of the sound may be averaged together.

It's the Optometrist approach, and requires either the use of a micro-controller with a digital-to-analog converter to produce the sounds and ask the musician for decisions, or presentation by a person customizing the guitar. The inverse-FFT characteristic sound of each of two switched circuits plays back to the musician, and the software asks, "Which sound is warmer? Tone A? Or Tone B?" Or, the guitar customizer simply plays the tones on the guitar and asks the same questions. Then the musician picks, and the use of an efficient sorting algorithm, such as a shell sort, determines the order of the tones for switching. Then the entire set is played back in order for confirmation and adjustment.

The following examples include equations and tables to help illustrate the method.

Example 1: Choosing 6 Tones from Table 10 Using Mean Frequency for a 6P6T Switch Suppose that the only switch available is a 6P6T mechanical switch, and we wish to use the entire frequency range in Table 10 from 632.9 to 1201.1 Hz. Math 14 shows a simple way to calculate the ratio between frequency steps, r, where the lowest frequency, 632.9 Hz, is multiplied by r five times to get the highest frequency and all the steps in between for a 6-throw switch.

Math 14

$$\text{a) } 1201.1 = r^5 * 632.9$$

$$\text{b) } r = \sqrt[5]{12011/632.9} = 1.13671 \ldots$$

$$\text{c) note: } r = 2^{\frac{a}{5*12}} = 2^{\frac{a}{60}}$$

$$\text{d) } a = 60\frac{\ln(r)}{\ln(2)} = 11.0917 \ldots \text{ fret steps}$$

| throw | 1 | 2 | 3 | 4 | 5 | 6 |
|---|---|---|---|---|---|---|
| *freq*(Hz) | 632.9 | 719.4 | 817.8 | 929.6 | 1056.6 | 1201.1 |

It is usually not possible to use the measured mean frequencies to hit those marks exactly. So one takes the choices that seem best. The first frequency, 632.9 Hz, has a pickup combination, S1overN1N2S2, a quad circuit. The closest ones to 719.4 Hz are 712.6 at 0.74 relative amplitude and 713.5 at 2.05 amplitude. The best choice is 713.5 Hz, from combination N1overS2. The 3rd frequency, 817.8 Hz, is 24.9 Hz up from 792.9 and 9.8 Hz down from 827.0 Hz. If signal strength is important, then the lower frequency would be better, but the relative amplitude of the highest frequency output, 1201.1 Hz only has a relative amplitude of 0.23, so S2overN1S1N2 at 827.0 Hz it is. The closest and only choices for 929.6 and 1056.6 Hz are N1overS1N2 at 933.1 Hz and N1S1over N2S2 at 1006.8 Hz, leaving N1overN2S2 at 1201.1 Hz. Table 14 shows the chosen order brightest to warmest tones, according to the mean frequencies of 6 strummed strings.

TABLE 14

Order of tones from 1202 Hz to 633 Hz for a 6P6T switch

| Throw | 1 | 2 | 3 | 4 | 5 | 6 |
|---|---|---|---|---|---|---|
| Pickup circuit | N1 N2S2 | N1S1 N2S2 | N1 S1N2 | S2 N1S1N2 | N1 S2 | S1 N1N2S2 |
| Mean freq (Hz) | 1201.1 | 1006.8 | 933.1 | 827.6 | 713.5 | 632.9 |
| ~Fret number | 11.1 | 8.0 | 6.7 | 4.6 | 2.1 | 0 |
| Relative Amplitude | 0.23 | 0.25 | 0.78 | 0.49 | 2.05 | 0.63 |

Compare this to Table 15, representing a 3-way switch giving the bridge HB, the neck and bridge HB in parallel, and the neck HB.

TABLE 15

Outputs for a standard 3-way switch

| Throw | 1 | 2 | 3 |
|---|---|---|---|
| Pickup circuit | N2 S2 | N1N2 S1S2 | N1 S1 |
| Mean freq (Hz) | 907.5 | 741.4 | 636.1 |
| ~Fret number | 6.2 | 2.7 | 0 |
| Relative Amplitude | 2.59 | 2.55 | 2.83 |

The representation for the middle of the 3-way switch may not be entirely correct, because in this circuit, the center taps of the HB are connected to each other, whereas they are not with a standard 3-way switch. Note also that the relative amplitudes for choices on the 3-way switch are relatively equal to each other, and much larger than those for this switching system using a 6-way switch, by as much as 12.3 times. This means that the output of the 6P6T switching system will have to be electronically amplified, and the gains switched as well to equalize the volumes of the signals. This was addressed in the section on embodiments.

Example 2: Choosing 6 Tones from Table 4 Using Weighted Moments

Suppose it should be determined that a better measure of tones comes from giving a weight of 1 to the mean frequency, ½ to the square root of the $2^{nd}$ moment, and ⅓ to the $3^{rd}$ root of the 3rd moment in Table 3. The normalized fractions would be 6/11 of the mean frequency, 3/11 of the root $2^{nd}$ moment and 2/11 of the root $3^{rd}$ moment, as shown ordered by Weighted moments in Table 16.

TABLE 16

Coil circuits ordered by weighted moments, Weighted = $6*(1^{st})/11 + 3*(\text{root-}2^{nd})/11 + 2*(\text{root-}3^{rd})/11$

| Coils | Signal Amplitude | Moments (Hz) 1st | Root-2nd | Root-3rd | Weighted |
|---|---|---|---|---|---|
| N1oS1 | 2.83 | 636.1 | 684.2 | 1224.3 | 756.2 |
| S1oN2S2 | 1.33 | 637.4 | 687.4 | 1226.4 | 758.1 |
| S1oN1N2S2 | 0.63 | 632.9 | 699.4 | 1235.3 | 760.6 |
| N1oS1N2S2 | 0.40 | 633.2 | 708.9 | 1247.4 | 765.5 |
| S1oN1S2 | 1.91 | 655.1 | 704.8 | 1252.0 | 777.2 |
| S1oN1N2 | 2.23 | 672.2 | 704.6 | 1259.0 | 787.7 |
| N1oS1S2 | 2.59 | 669.8 | 717.1 | 1275.0 | 792.7 |
| S2oN2S1 | 1.30 | 683.4 | 714.9 | 1274.3 | 799.4 |
| N2oN1S2 | 0.74 | 712.6 | 718.1 | 1288.1 | 818.7 |
| N1oS2 | 2.05 | 713.5 | 722.7 | 1295.3 | 821.8 |
| N1N2oS1S2 | 2.55 | 741.4 | 743.2 | 1329.1 | 848.7 |
| S1oN2 | 2.31 | 770.5 | 740.1 | 1337.7 | 865.3 |
| N2oS1S2 | 2.18 | 792.8 | 752.8 | 1363.7 | 885.7 |
| S2oN1N2 | 2.64 | 792.9 | 754.2 | 1362.3 | 885.8 |
| S1oS2 | 0.88 | 835.0 | 752.8 | 1380.1 | 911.7 |
| N1S2oS1N2 | 1.02 | 837.0 | 750.1 | 1379.9 | 912.0 |
| N1oN2 | 1.15 | 843.0 | 752.3 | 1387.5 | 917.3 |
| S2oN1S1N2 | 0.49 | 827.6 | 783.5 | 1413.4 | 922.1 |
| N2oN1S1S2 | 0.26 | 854.7 | 756.4 | 1398.3 | 926.7 |
| S2oN1S1 | 0.36 | 837.2 | 822.7 | 1454.7 | 945.5 |
| N2oN1S1 | 0.31 | 849.3 | 824.7 | 1468.2 | 955.1 |
| N2oS2 | 2.59 | 907.5 | 771.0 | 1440.7 | 967.2 |
| N1oS1N2 | 0.78 | 933.1 | 794.6 | 1474.9 | 993.8 |
| N1S1oN2S2 | 0.25 | 1006.8 | 868.2 | 1598.4 | 1076.5 |
| N1oN2S2 | 0.23 | 1201.1 | 873.1 | 1724.2 | 1206.7 |

Suppose that the same 6-throw switch will be used, with 756.2 Hz the lowest tone, 1206.7 Hz the highest tone, and 4 in between, all separated by the same frequency multiplier. Math 15 shows the calculations.

Math 15

$$\text{a) } 1206.7 = r^5 * 756.2$$

$$\text{b) } r = \sqrt[5]{1206.7/756.2} = 1.097975 \ldots$$

$$\text{c) note: } r = 2^{\frac{a}{5*12}} = 2^{\frac{a}{60}}$$

$$\text{d) } a = 60\frac{\ln(r)}{\ln(2)} = 8.09 \ldots \text{ fret steps}$$

| throw | 1 | 2 | 3 | 4 | 5 | 6 |
|---|---|---|---|---|---|---|
| *freq*(Hz) | 756.2 | 830.3 | 911.6 | 1001.0 | 1099.0 | 1206.7 |

For 830.3 Hz, 821.8 is 8.5 Hz below and 848.7 is 18.4 above, leaving 821.8 Hz the closest. For 911.6 Hz, 911.7 is closest. For 1001.0 Hz 993.8 Hz is closest, leaving 1076.5 for 1099.0 and 1206.7 Hz. Table 7 shows the results of these choices. Because of the dearth of choices at the high end, only the choices for throws 4 and 6 have changed from Table 4.

TABLE 17

Order of 6 tones from 1207 Hz to 756 Hz for Weighted moments

| Throw | 1 | 2 | 3 | 4 | 5 | 6 |
|---|---|---|---|---|---|---|
| Pickup circuit | N1 N2S2 | N1S1 N2S2 | N1 S1N2 | S1 S2 | N1 S2 | N1 S1 |
| Mean freq (Hz) | 1206.7 | 1076.5 | 993.8 | 911.7 | 821.8 | 756.2 |
| ~Fret number | 8.1 | 6.1 | 4.7 | 3.2 | 1.4 | 0 |
| Relative Amplitude | 0.23 | 0.25 | 0.78 | 0.88 | 2.05 | 2.83 |

Example 3: Steps of ½ Fret or More from Table 3 Using Mean Frequency

Suppose that we wish to remove the near-duplicate tones by specifying that the difference in virtual fret step between tones be 0.5 fret or greater, or a frequency multiplier of $2^{1/24}$, from Table 10. Obviously, not all of those slots will be filled, and some closer choice may be sacrificed for another with a larger signal. Table 18 shows the first-cut list, choosing 12 out of 25 circuits, with approximate fret steps between mean-frequency choices ranging from 0.5 to 3.1. The first column starts with the first choice, 632.9 Hz, with the value for the half-fret step up in the second column. The next value in the first column is taken from that, either 0.5 fret or more, and so on, except that 933.1 Hz is chosen instead of 934.1 Hz because it is so close. The signal for 792.9 Hz was chosen over 792.8 Hz because it had a stronger signal. The $3^{rd}$ column shows the relative number of frets from 632.9 Hz; the $4^{th}$ shows the relative measured amplitude of the signal derived from 6 strummed strings; and the $5^{th}$ shows the coil connections, with the "+" output shown over the "−" output. The $6^{th}$ column shows the amplifier gain for each switching combination required to equalize all the signals to the amplitude of the strongest signal, 792.9 Hz for S2 over N1N2. They range from 1.0 to 11.47

TABLE 18

Half-fret or more steps from Table 13

| Choice | ½-Fret Up | Fret Step | Relative Amplitude | Coils | Required Gain |
|---|---|---|---|---|---|
| 632.9 | 651.4 | 0.0 | 0.633 | S1 N1N2S2 | 4.17 |
| 655.1 | 674.3 | 0.6 | 1.907 | S1 N1S2 | 1.38 |
| 683.4 | 703.4 | 1.3 | 1.297 | S2 N2S1 | 2.03 |
| 712.6 | 733.5 | 2.1 | 0.745 | N2 N1S2 | 3.54 |
| 741.4 | 763.1 | 2.7 | 2.548 | N1N2 S1S2 | 1.03 |
| 792.9 | 816.1 | 3.9 | 2.637 | S2 N1N2 | 1.00 |
| 827.6 | 851.9 | 4.6 | 0.489 | S2 N1S1N2 | 5.40 |
| 854.7 | 879.7 | 5.2 | 0.261 | N2 N1S1S2 | 10.10 |
| 907.5 | 934.1 | 6.2 | 2.588 | N2 S2 | 1.02 |
| 933.1 | 960.4 | 6.7 | 0.775 | N1 S1N2 | 3.40 |
| 1006.8 | 1036.3 | 8.0 | 0.252 | N1S1 N2S2 | 10.46 |
| 1201.1 | 1236.3 | 11.1 | 0.230 | N1 N2S2 | 11.47 |

Example 4: Steps of ½ Fret or More from Table 6 Using Weighted Moments

Table 19 shows the same method used for Table 18, using weighted moments in Table 6, i.e., [6*(mean−freq)/11+3*(root−2$^{nd}$)/11+2*(root−3$^{rd}$)/11] (Hz). In this table, 967.2 Hz with a 0.4 fret step is used because there was nothing else closer, and it allowed 12 tones instead of just 11. This gives a range of fret steps between weighted moments of 0.4 to 2.0. Under the criterion of 0.5 fret step or more, it could be discarded, leaving 11 tones, and a range of fret steps of 0.5 to 2.0. The range of gains required to equalize amplitudes goes from 1.0 to 12.32.

TABLE 19

Half-fret or more steps from Table 16 using weighted moments

| Choice | ½ Fret Up | Fret Step | Relative Amplitude | Coils | Required Gain |
|---|---|---|---|---|---|
| 756.2 | 778.3 | 0.0 | 2.83 | N1 S1 | 1.00 |
| 777.2 | 800.0 | 0.5 | 1.91 | S1 N1S2 | 1.49 |
| 799.4 | 822.8 | 1.0 | 1.30 | S2 N2S1 | 2.18 |
| 821.8 | 845.9 | 1.4 | 2.05 | N1 S2 | 1.38 |
| 848.7 | 873.6 | 2.0 | 2.55 | N1N2 S1S2 | 1.11 |
| 885.8 | 911.8 | 2.7 | 2.64 | S2 N1N2 | 1.07 |
| 911.7 | 938.4 | 3.2 | 0.88 | S1 S2 | 3.22 |
| 945.5 | 973.2 | 3.9 | 0.36 | S2 N1S1 | 7.86 |
| 967.2 | 995.6 | 4.3 | 2.59 | N2 S2 | 1.09 |
| 993.8 | 1023.0 | 4.7 | 0.78 | N1 S1N2 | 3.65 |
| 1076.5 | 1108.1 | 6.1 | 0.25 | N1S1 N2S2 | 11.24 |
| 1206.7 | | 8.1 | 0.23 | N1 N2S2 | 12.32 |

I claim the following, and as a Pro Se inventor with limited resources request the help of the Patent Examiner to state these claims correctly:

1. A sensor switching system, comprised of:

a. two or more matched vibration sensors, with two or more terminals, matched to produce:
   i. the same signal outputs to the same inputs of external interference, and
   ii. the same signal outputs to the same inputs of vibration, with one of two polarities, such that said vibration signal can be made or arranged to present either normal or opposite polarity, with respect to another of said matched sensors when placed in the same physical position, and b. a common connection point, to which all of all of said sensors are connected by their terminals which have the same phase of external interference signal, and c. a switching system, which
   i. connects at least one of said sensors to a high output terminal, and
   ii. connects at least one of another of said sensors to a low output terminal, and
   iii. connects the system reference ground to either said common connection point or said low output terminal, but not both in normal operation, except for special cases of circuit testing.

2. The sensors and system as cited in claim 1, wherein the switching is done by an electromechanical switch, in which two or more poles connect to the terminals of said sensors, which terminals are not connected to the common connection point.

3. The electromechanical switching system as cited in claim 2, wherein one or more of said switch poles not connected to said sensors are connected to components used for passively modifying the output signal of said switching system.

4. The electromechanical switching system as cited in claim 2, wherein the high and low outputs of the system are connected to electronic circuits intended to modify the system signal.

5. The electromechanical switching system as cited in claim 2, wherein the high and low outputs of the system are connected to electronic circuits intended to modify the system output signal, and one or more of said switch poles are used to select components used in said electronic circuits to modify said signal.

6. The electromagnetic switching system as cited in claim 2, wherein the connections of said switching system are made on a separate, replaceable plug board, such that, a. said board connects to a plug mounted near to said switching system, with said plug connected to the switch throws of said switching system, and none or more poles of said switching system, and b. connections from each of the throws of said switching system are connected either to the high or the low outputs of the output of said switching system, so as to create desired sensor circuits in the order of said throws, and c. components intended for modification of said switching system output signal are mounted and selected by one or more of said poles and throws of said switching system, and d. the resulting of said switched sensor circuits and their associated modifying components are presented to the plug area of the board, to be connected back into the switching system for further modification and output.

7. The plug board as cited in claim 6, which is programmable by manually changable interconnects from said throws of said switching system to said switching system high and low outputs.

8. The sensors and switching system as cited in claim 1, where the connections are made by solid-state analog switches with digital control lines to set the state of said switches, said switches performing the functions of:

a. connecting a terminal of one of said sensors, not connected to said common connection point to either of:
   i. nothing, or
   ii. said high output of said switching system, or
   iii. said low output of said switching system, or
   iv. said common connection point of said switching system, and b. connecting said system ground to either of:
   i. said common connection point, or
   ii. said low output terminal, and c. connecting said common connection point to said low output terminal for test purposes, and d. connecting passive components within said switching system to modify the signal output of said system.

9. The sensors and solid-state switching system as cited in claim 8, wherein said digital control lines are driven by a digital sequencer controlled by an up-down switch, said switch and sequencer moving the state of the control lines from one sensor circuit to the next and back, said sequencer acting as a digital up-down ripple counter with outputs isolated from undesired control lines by diode or transistor isolation, such that only one desired sensor circuit and set of signal modification components are chosen for each output state of the sequencer.

10. The sensors and solid-state switching system as cited in claim 8, wherein said digital control lines are driven by a programmable micro-controller system, said micro-controller system performing the functions of:

a. driving said digital controls of said solid-state analog switches according to a program to produce a desired sequence of possible circuits of said sensors, and
b. driving a set of one or more controls and one or more displays, so as to allow a user to:
   i. choose the current sensor circuit and operating state of said sensor and switching system, and
   ii. choose the order of selection of said sensor circuits and operating states of said system, and
   iii. inspect said order of selection of said sensor circuits, and
   iv. inspect said order of said operating states of said system, and
   v. see which of said sensor circuits and operating states are currently active, and
   vi. perform testing and calibration so as to determine the desirability of said order of said sensor circuits and operating states of said system, and
c. using an analog-to-digital converter to digitize samples of said output signal of said switching system, and storing said samples, such that spectral analysis of said output signal can be performed by said micro-controller using a math processing unit, and
d. performing and storing inverse spectral analysis with a math processing unit so as to provide analog signals with a digital-to-analog converter to help the user in ordering said sensor circuits, according to tone, and
e. using said spectral analysis to determine and adjust the gain of analog output circuits for said switching system, so that the signals from different said sensor circuits sound substantially at the same output level.

11. A method for ordering the tones of vibration signals from two or more sensor circuits, comprised of:

a. picking a standardized way of exciting vibrations, including:
   i. causing one or more of the strings of a stringed instrument to vibrate, and
   ii. playing one or more notes on a wind instrument, and
   iii. striking one or more places on a percussion instrument, and
   iv. using ultrasonic excitation on an arrangement of matter, and
   v. using explosive excitation on an arrangement of matter, and
   vi. using electromagnetic excitation on an arrangement of matter, and
b. measuring and recording said excited vibrations for each and every available sensor circuit, and
c. calculating and storing a complex frequency spectrum, including magnitude and phase or real and imaginary parts, from each of said recordings,
   i. using one or more orthogonal functions in said calculation, including:
      1. sine and cosine, and
      2. Walsh functions, and
      3. Chebeshev polynomial functions, and
      4. Haar functions, and
      5. Rademacher functions, and
      6. Block pulse functions, and
      7. Slant functions, and
      8. Piecewise orthogonal functions, and
      9. Orthogonal polynomials, and
      10. Legendre polynomials, and
d. Calculating inverse transforms of spectra and storing them as vibration time series samples to aid in later user identification of tones with said sensor circuits, and
e. adjusting said calculated frequency spectra according to human psychoacoustics, including:
   i. A-weighting, and
   ii. masking functions, and
   iii. no adjustments, and
f. calculating from said frequency spectra:
   i. their relative signal magnitudes, and
   ii. their mean frequency, and
   iii. their individual moments about the mean, and
   iv. the roots of said moments about the mean to match units with mean frequency, and
g. weighting said mean and moments and root-moments into a one or more terms of measure of tone for each sensor circuit, and
h. using said measures, measurements and calculations to:
   i. order the selection sequence of said sensor circuits in a switching system sequence according to measure of tone, and
   ii. use relative amplitudes of each sensor circuit outputs to adjust the amplification of said sensor circuit outputs to substantially equal loudness, as perceived by the human ear, and,
i. using said measures, measurements and calculations to:
   i. calculate the extreme spread of said sensor circuit tones measures, and
   ii. match said extreme spread of tonal measures to the available number of switching states for said sensor circuits, such that for j number of said switching states, the ration, r, multiplied j−1 times the lowest tonal measure in said extreme spread will equal the highest tonal measure in said extreme spread, and
   iii. calculate the desired tonal separation of said switching states as a factor of r times a lower tonal measure to the next higher one, and
j. pick the switching sequence of said sensor circuits, such that
   i. the number of said sensor circuits used matches the number of available switching states, and
   ii. the tonal measure of said sensor circuits matches said calculated tonal sequence according to the ratio, r, as closely and practicably as possible,
   iii. except that exceptions may be made to take advantage of said sensor circuits with larger relative amplitudes, and tones that may be considered more advantageous, and
k. external communications, for the purposes of:
   i. testing, and
   ii. reprogramming, and
   iii. control of the switching system with external computer, display and keyboard equipment, and
   iv. other useful functions.

* * * * *